US007896328B2

(12) United States Patent
Kawamura et al.

(10) Patent No.: US 7,896,328 B2
(45) Date of Patent: Mar. 1, 2011

(54) POSTPROCESSING DEVICE AND IMAGE FORMING DEVICE

(75) Inventors: Michihiro Kawamura, Kanagawa (JP); Kenji Kawana, Kanagawa (JP); Takashi Aoki, Kanagawa (JP); Daisuke Nagasaka, Kanagawa (JP); Kazuhisa Makita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/138,155

(22) Filed: Jun. 12, 2008

(65) Prior Publication Data

US 2009/0121407 A1 May 14, 2009

(30) Foreign Application Priority Data

Nov. 12, 2007 (JP) ..... 2007-292952

(51) Int. Cl.
*B42C 1/10* (2006.01)
*B41L 43/00* (2006.01)
*B65H 33/04* (2006.01)

(52) U.S. Cl. ..... 270/51; 270/32; 270/58.07

(58) Field of Classification Search ..... 270/32, 270/45, 58.07, 32.45
See application file for complete search history.

(56) References Cited

U.S. PATENT DOCUMENTS

| | | | | |
|---|---|---|---|---|
| 3,685,820 | A * | 8/1972 | Surbrook | 493/360 |
| 5,819,666 | A * | 10/1998 | Ishikawa et al. | 101/483 |
| 6,196,959 | B1 * | 3/2001 | Jorg et al. | 493/23 |
| 7,563,218 | B2 * | 7/2009 | Thoma | 493/23 |
| 2006/0217253 | A1 * | 9/2006 | Thoma | 493/432 |
| 2007/0045921 | A1 * | 3/2007 | Suzuki et al. | 270/37 |
| 2007/0063409 | A1 * | 3/2007 | Sugimoto et al. | 270/58.09 |

FOREIGN PATENT DOCUMENTS

| | | | |
|---|---|---|---|
| JP | 6072064 | | 3/1994 |
| JP | 10091040 | | 4/1998 |
| JP | 2005008337 | | 1/2005 |
| JP | 2006-253873 | A | 9/2006 |
| JP | 2006253873 | A * | 9/2006 |

* cited by examiner

*Primary Examiner* — Gene Crawford
*Assistant Examiner* — Yolanda Cumbess
(74) *Attorney, Agent, or Firm* — Sughrue Mion, PLLC

(57) ABSTRACT

A postprocessing unit of a postprocessing device performs a postprocess including a preset folding process at a set folding position, with respect to recording sheets. A setting unit of the postprocessing device sets an adjustment amount of the folding position on the basis of a target value of the folding position, a measured value of the folding position after the folding process, and sheet quality information of the recording sheets. An adjusting unit of the postprocessing device adjusts the folding position of the postprocessing unit on the basis of the adjustment amount set by the setting unit. An adjustment control unit of the postprocessing device controls the adjustment by the adjusting unit on the basis of the adjustment amount set by the setting unit.

11 Claims, 18 Drawing Sheets

POSTPROCESSING DEVICE AND IMAGE FORMING DEVICE

CROSS-REFERENCE TO RELATED APPLICATION

This application is based on and claims priority under 35 USC 119 from Japanese Patent Application No. 2007-292952 filed Nov. 12, 2007.

BACKGROUND

1. Technical Field

The present invention relates to a postprocessing device and an image forming device.

2. Related Art

A postprocessing device, in cooperation with an image forming device, to recording sheets on which an image is formed by the image forming device, performs a postprocess to sort, fold, or staple the recording sheets.

SUMMARY

The present invention provides a postprocessing device, and an image forming device, that can simplify adjustment work of a folding process of recording sheets.

According to an aspect of the invention, there is provided a postprocessing device including, a postprocessing unit that performs a postprocess including a preset folding process at a set folding position, with respect to recording sheets, a setting unit that sets an adjustment amount of the folding position on the basis of a target value of the folding position, a measured value of the folding position after the folding process, and sheet quality information of the recording sheets, an adjusting unit that adjusts the folding position of the postprocessing unit on the basis of the adjustment amount set by the setting unit, and an adjustment control unit that controls the adjustment by the adjusting unit on the basis of the adjustment amount set by the setting unit.

BRIEF DESCRIPTION OF THE DRAWINGS

Exemplary Embodiments of the present invention will be described in detail based on the following figures, wherein.

DETAILED DESCRIPTION

First Exemplary Embodiment

Figure 1:
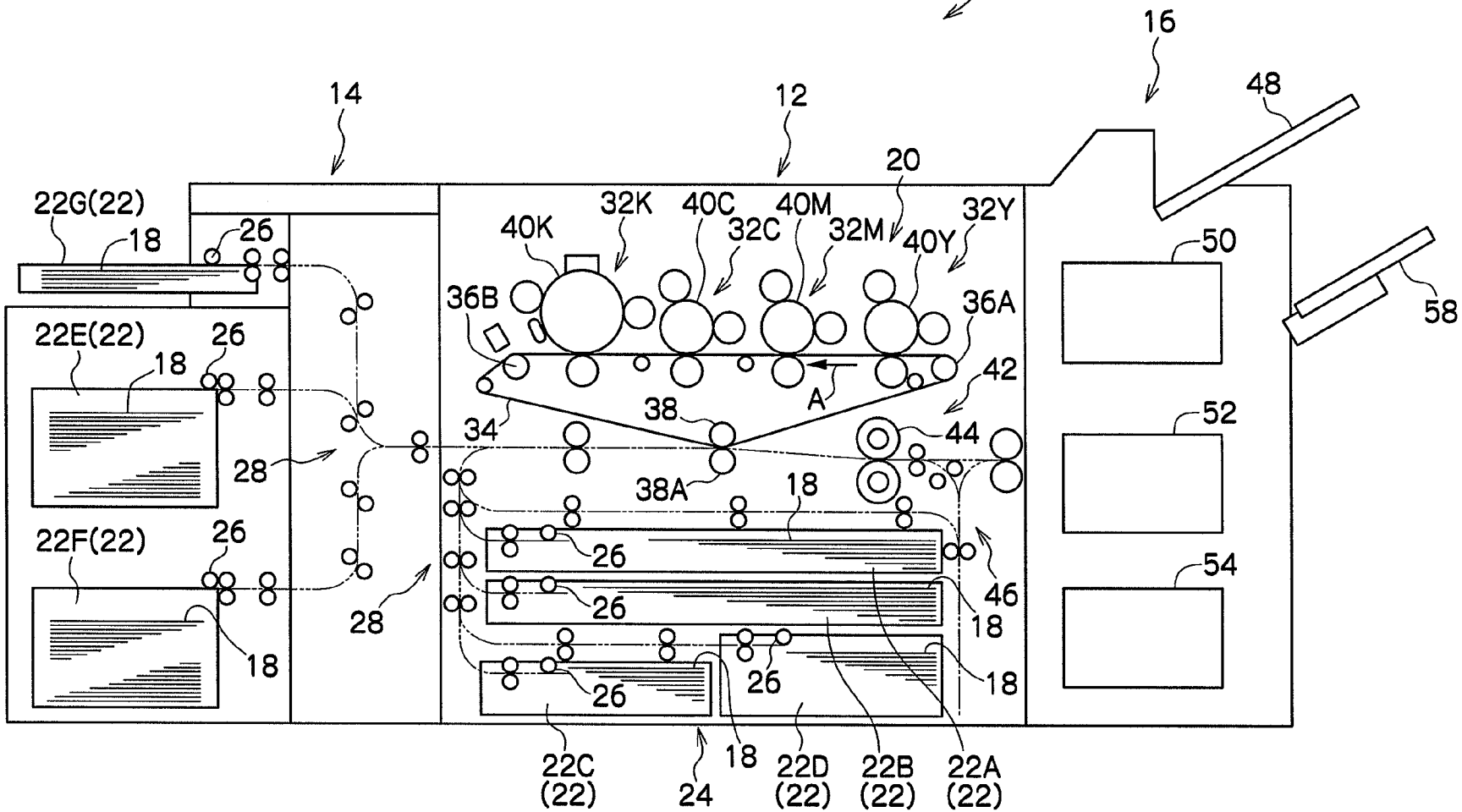
FIG. 1 is a schematic figure showing an outline structure of an image forming device according to a first exemplary embodiment.

FIG. 1 is a schematic figure showing an example of a structure of an image forming device 10 according to a first exemplary embodiment.

The image forming device 10 is structured of a main body 12, and an additional tray device 14 that is connected to the main body 12, and a finisher 16 that become a postprocessing device.

In this image forming device 10, an image corresponding to image data that is input into the main body 12 is formed on a recording sheet 18. In such an image forming device 10, the main body 12 is connected to various image forming devices such as a personal computer, a server and the like via a network, and on the basis of the image data that are input as print jobs from these image forming devices, a print process is performed.

Further, as the image forming device 10, a scanner (image reading device) equipped with an automatic manuscript feeding function may be connected to the main body 12, and an image based on the image data of the manuscript that is read and generated by this scanner may be formed on the recording sheet 18.

In the device main bodies 12 of the image forming device 10, an image forming unit 20 that forms images onto recording sheets 18 by an electronographic process, and a tray unit 24 that is equipped with plural trays 22 to contain many recording sheets 18 are arranged, and the main body 12 forms an image forming device of a stand-alone simple structure.

In the tray unit 24, as an example of plural trays 22, trays 22A, 22B to contain the recording sheets 18 of a comparatively large size, and trays 22C, 22D to contain the recording sheets 18 of a comparatively small size are arranged, and many recording sheets 18 are laminated and contained in the trays 22A through 22D respectively.

In addition, in the additional tray device 14 connected to the main body 12, trays 22E, 22F in which many recording sheets 18 can be contained, and a tray 22G for manual sheet feeding are arranged. Meanwhile, hereinafter, the trays 22A-22G including the tray 22G for manual sheet feeding are referred generally as trays 22.

In the trays 22, feed rollers 26 that take out the recording sheets 18 from top layers are arranged, and, and transportation paths 28 to transport the recording sheets 18 taken out from each of the trays 22 to the image forming unit 22.

Thereby, in the main body 12, the recording sheets 18 are taken out one by one from the trays 22, and transported (fed) to a predetermined position of the image forming unit 20.

In the image forming unit 20, developing units 32Y, 32M, 32C, 32K of respective colors of Y (yellow), M (magenta), C (cyan) and K (black) are arranged as image forming system devices. In addition, in the image forming unit 20, an endless transfer belt 34 is arranged as an intermediate holding body.

The transfer belt 34 is arranged around roller 36A, 36B and a transfer roller 38 at the side of the transportation paths of the recording sheets 18, and is driven to rotate at a constant speed in the arrow A direction. In addition, the transfer belt 34 contacts with photo receptor drums 40Y, 40M, 40C, 40K arranged in the developing units 32Y, 32M, 32C, 32K.

Into the image forming unit 20, image signals (raster data) of the respective colors of Y, M, C, K generated on the basis of the image data are input, and in the image forming unit 20, on the basis of these image signals, in the respective developing units 32Y, 32M, 32C, 32K, toner images of the respective colors of Y, M, C, K are formed on the photo receptor drums 40Y, 40M, 40C, 40K, and the respective toner images are superimposed and transferred on the transfer belt 34.

In addition, in the image forming unit 20, a roller (bias transfer roller) 38A is arranged to oppose the transfer roller 38, and a recording sheet 18 taken out from the tray 22 is sent into between the transfer roller 38 and the bias transfer roller 38A, and it is pinched by the transfer roller 38 and the bias transfer roller 38A together with the transfer belt 34.

Thereby, the recording sheet 18 is sent out, while the toner image of the transfer belt 34 is copied thereunto. In addition, the transfer belt 34 is structured so as not to affect the image (toner image) to which a joint line is copied substantially.

In the image forming unit 20, a fixation unit 42 is arranged as an image forming system device. The fixation unit 42 is equipped with a pair of fixation rollers 44, and the recording sheet 18 onto which the toner image is transferred is sent into between this pair of fixation rollers 44.

The fixation unit 42 pinches the recording sheet 18 sent into the interval of the fixation rollers 44 by the fixation rollers 44 and pressurizes and heats it, and fixes the toner image onto the recording sheet 18. Thereby, an image corresponding to the image data is formed on the recording sheet 18. In addition, in forming a color image on the recording sheet 18, the developing units 32Y, 32M, 32C, 32K are used, meanwhile in forming a black and white image, the developing unit 32K is used.

To such an image forming unit 20, image formation of the general structure using an electronographic process may be applied, and the explanation thereof is omitted in the first exemplary embodiment.

In the main body 12, a circulation transportation path 46 to transport the recording sheet 18 that has passed the image forming unit 20, to the image forming unit 20 again is formed. In the transportation path 46, the recording sheet 18 that passes the fixation unit 42 is sent into, and this recording sheet 18 is reversed, and sent into the transportation path 28. In other words, in the circulation transportation path 46, when the the recording sheet 18 passes the image forming unit 20 for the first time, the recording sheet 18 is reversed so that the surface thereof that opposes the transfer belt 34 becomes the reverse side of the transfer belt 34.

Thereby, in the main body 12, duplex printing to form an image in each of both the sides of the recording sheet 18 is possible.

On the other hand, when the image formation (print process) to the recording sheet 18 is finished, the main body 12 sends this recording sheet 18 to the finisher 16.

In the finisher 16, a output tray 48 that laminates and accumulates many recording sheets 18 is arranged.

In addition, in the finisher 16, a pamphlet preparation unit 50, a staple unit 52, and a folding unit 54 are arranged as a postprocessing device for the recording sheets 18. In the pamphlet preparation unit 50, a preset number of the recording sheets 18 are piled up and bound, and then folded into two and the like, and are output to the tray 58 in the form of a pamphlet.

In the staple unit 52, the preset number of the recording sheets 18 are piled up, and preset positions of the margin of the piled recording sheets 18 are stapled and the recording sheets 18 are output to the tray 58.

In addition, in the folding unit 54, the recording sheets 18 are folded into preset folding types such as two-folding, Z-folding and other folding types, and then output to the tray 58.

Meanwhile, the Z-folding and other folding types may be performed by the pamphlet preparation unit 50. In addition, as for the pamphlet preparation unit 50, the staple unit 52 and the folding unit 54 of the finisher 16, conventionally well-known structures may be used. In addition, the finisher 16 may have other postprocessing functions, and in such a case, necessary devices may be arranged. In addition, the output from the pamphlet preparation unit 50, the staple unit 52, and the folding unit 54 is not limited to the tray 58, but may be changed to the tray 48 appropriately.

Figure 2B:
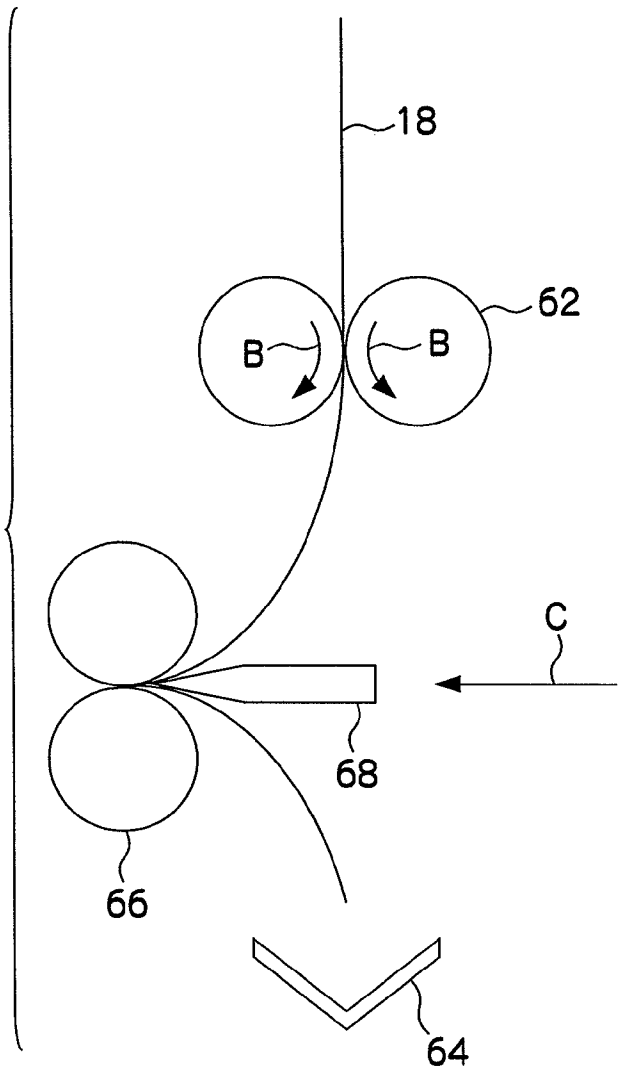
FIG. 2B is a schematic figure showing an outline structure of a folding mechanism that performs a folding process of recording sheets according to the first exemplary embodiment.
Figure 2A:
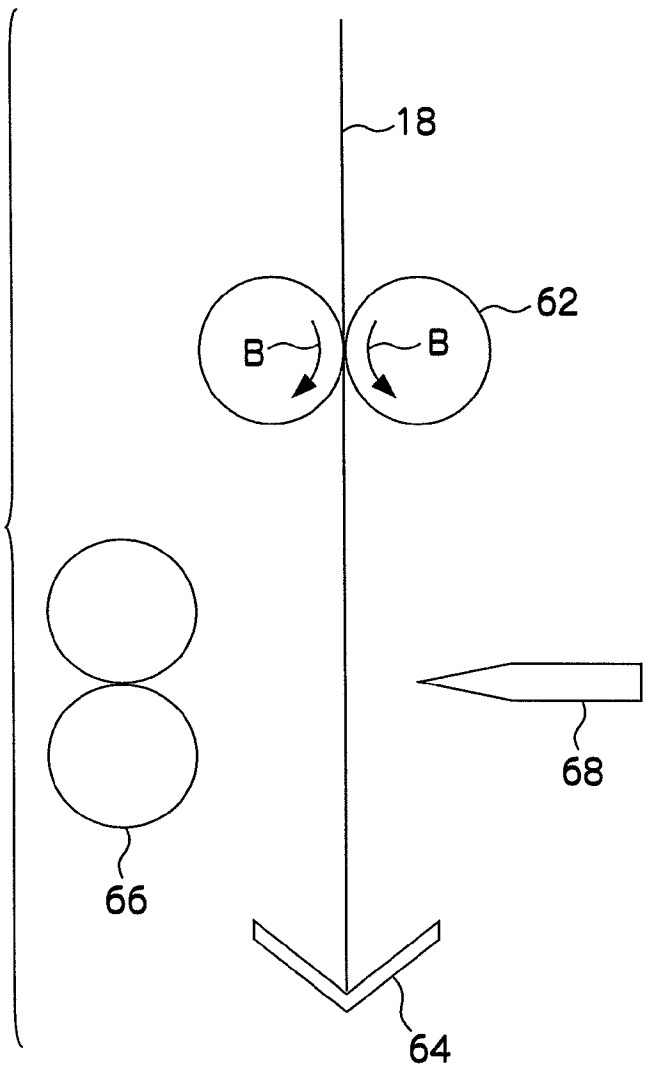
FIG. 2A is a schematic figure showing an outline structure of a folding mechanism that performs a folding process of recording sheets according to the first exemplary embodiment.

FIG. 2A and FIG. 2B are each a schematic figure showing an outline structure of a folding mechanism that performs the folding process of the recording sheets 18.

As shown in FIG. 2A, the recording sheets 18 are transported when a pair of transportation rollers 62 are rotated in the arrow B direction, and are hit against a gate 64. When the recording sheets 18 are knocked against the gate 64, the transportation stops. When the transportation of the recording sheets 18 stops, as shown in FIG. 2B, a knife-shaped folding member 68 moves to a pair of rolls 66 in the arrow C direction, and push the recording sheets 18 into the folding rolls 66. Meanwhile, the transportation rollers 62 do not disturb the movement of the recording sheets 18 by a one-way clutch mechanism and the like. As a result, the recording sheets 18 are turned in by the rolls 66.

The folding position of the recording sheets 18 is decided by the amount of deflection at which they are pushed out from the transportation rollers 62. It is ideal that the recording sheets 18 do not bend, but they may bend due to quality of sheet (unbending strength, thickness, basis weight and the like of the recording sheets 18), and the amount of deflection thereof differs. Therefore, it is necessary to adjust the folding position according to the quality of sheet of the recording sheets 18.

Figure 3:
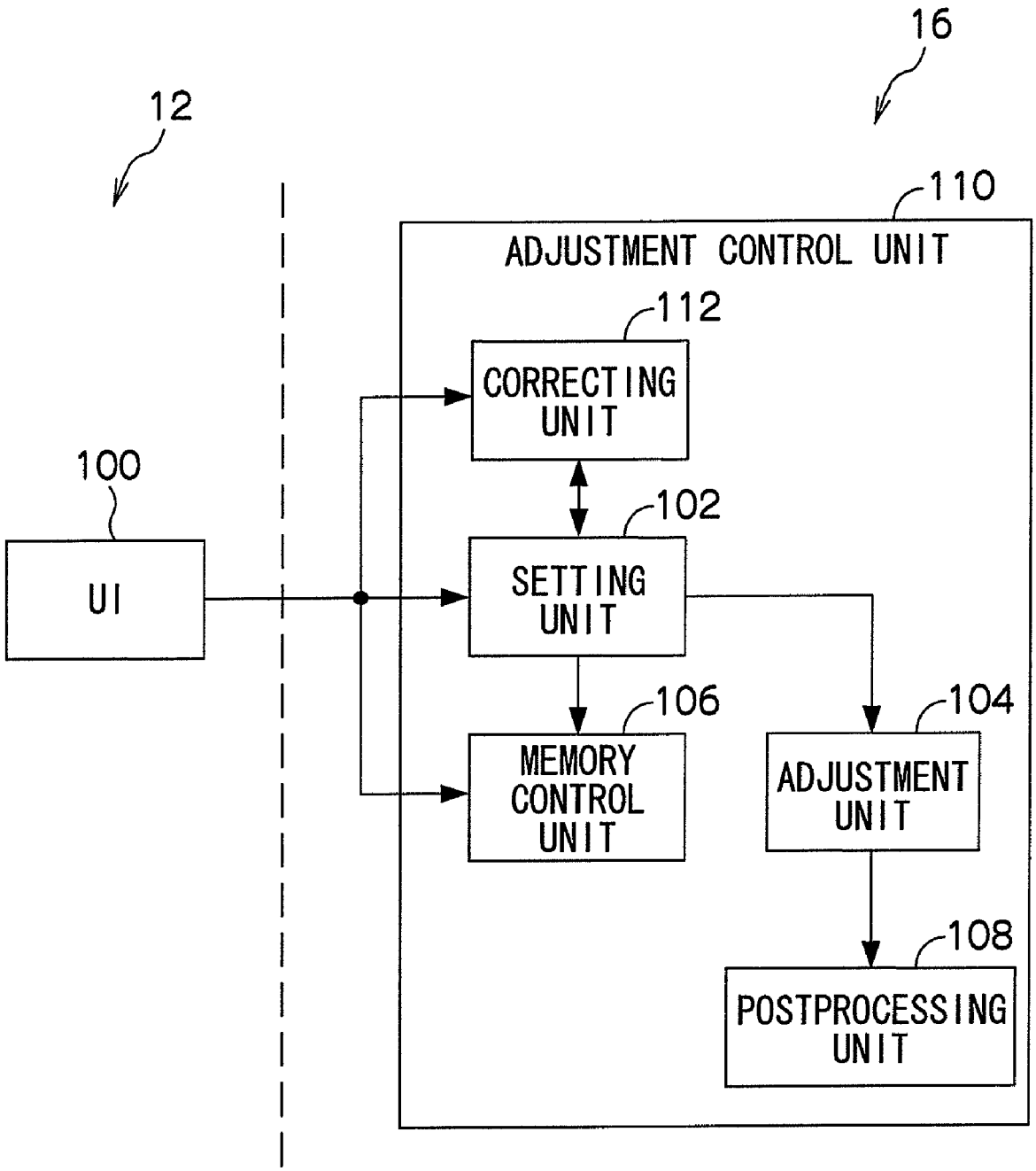
FIG. 3 is a functional block diagram showing a function of an adjustment process of a folding position according to the first exemplary embodiment.

FIG. 3 is a functional block diagram showing the function of the adjustment process of the folding position according to the first exemplary embodiment.

A UI (user interface) 100 of the main body 12 is connected to a setting unit 102, a memory control unit 106, a correcting unit 112 of the finisher 16. The UI 100 is an operation screen of a touch panel piled on a display panel consisting of a liquid crystal display panel not illustrate but arranged in the main body 12, and instructions such as image forming processing and postprocessing and the like are input therein. When the adjustment process of the folding position is performed, the UI 100 sends out the kinds of folding process to the setting unit 102, e.g. the target value of the folding position, the measured values of the folding position after the folding process, the sheet quality information of the recording sheets 18, sends out the information of the tray 22 in which the recording sheets 18 are contained to the memory control unit 106, and sends out the number of the recording sheets 18 to the correcting unit 112.

The setting unit 102 is connected to the memory control unit 106, the adjustment unit 104, and the correcting unit 112. The setting unit 102 calculates the adjustment amount from the difference between the target value of the folding position of the recording sheets 18 sent out by using the UI 100, and the measured values of the folding position after the folding process, and sets the adjustment amount on the basis of the sheet quality information of the recording sheets 18. The setting unit 102 sends out the set adjustment amount to the correcting unit 112. In addition, the setting unit 102 sends out the adjustment amount sent out from the correcting unit 112 to the adjustment unit 104 and the memory control unit 106.

The correcting unit 112 corrects the adjustment amount sent out from the setting unit 102 on the basis of the number of the recording sheets 18 sent out from the UT 100. The correcting unit 112 sends out the corrected adjustment amount to the setting unit 102.

Thus, the correcting unit 112 corrects the adjustment amount according to the number of the recording sheets to be turned in, and accordingly, it is possible to obtain more precise an adjustment amount than in the case where the adjustment amount is not corrected according to the number of the recording sheets.

The adjustment unit 104 is connected to a postprocessing unit 108. The adjustment unit 104 adjusts the folding position that the postprocessing unit 108 on the basis of the adjustment amount set by the setting unit 102.

The postprocessing unit 108 performs a folding process in the the folding unit 54 (refer to FIG. 1) on the basis of the folding position adjusted by the adjustment unit 104.

The memory control unit 106 makes the connection between the adjustment amount set by the setting unit 102, and the information of the tray 22 in which the recording sheets 18 sent out from the UT 100 are contained, and stores them into a nonvolatile memory.

Thus, the memory control unit 106 uses sheet trays as identification information, and accordingly, it is possible to cope with a use method in which the same recording sheets are contained in a same sheet tray.

The adjustment control unit 110 controls the processes in the setting unit 102, the adjustment unit 104, the memory control unit 106, the postprocessing unit 108, and the correcting unit 112.

Hereinafter, the action of the first exemplary embodiment is explained.

In the image forming device 10, when image data is input into the main body 12, an image is formed by the image forming unit 20 on the basis of the input image data, and the recording sheet 18 is transported from the tray 22, and the formed image is transferred onto the recording sheet 18, and thereby, the image formation (print processing) is completed.

When other postprocessing instruction than the imaging instruction is input from the UT 100, the recording sheets 18 one which an image is formed are sent into the finisher 16.

In the finisher 16, according to the postprocessing instructions input from the UT 100, in the case of the folding process, the postprocessing is carried out by the folding unit 54, and in the case of the stapling process, the postprocessing is carried out by the staple unit 52, and in the case of the pamphlet preparation process where a preset number of the recording sheets 18 are piled up and bound, and then folded into two, the postprocessing is carried out by the pamphlet preparation unit 50.

In the postprocesses, when the recording sheets 18 after the folding process are checked, there are cases where the folding process is not carried out at a desired folding position, and the folding position should be adjusted. The folding position has been so far adjusted by a customer service engineer, but the folding position can be adjusted by using the UT 100.

In addition, the adjustment of the folding position may be applicable to the case when the folding position set for recording sheets 18 as standard at the time of factory shipment of the image forming device 10 is adjusted, or the case when the folding position is changed to the adjustment amount that is previously adjusted, or when a displacement of the folding position that occurs as time goes by is adjusted.

Figure 4:
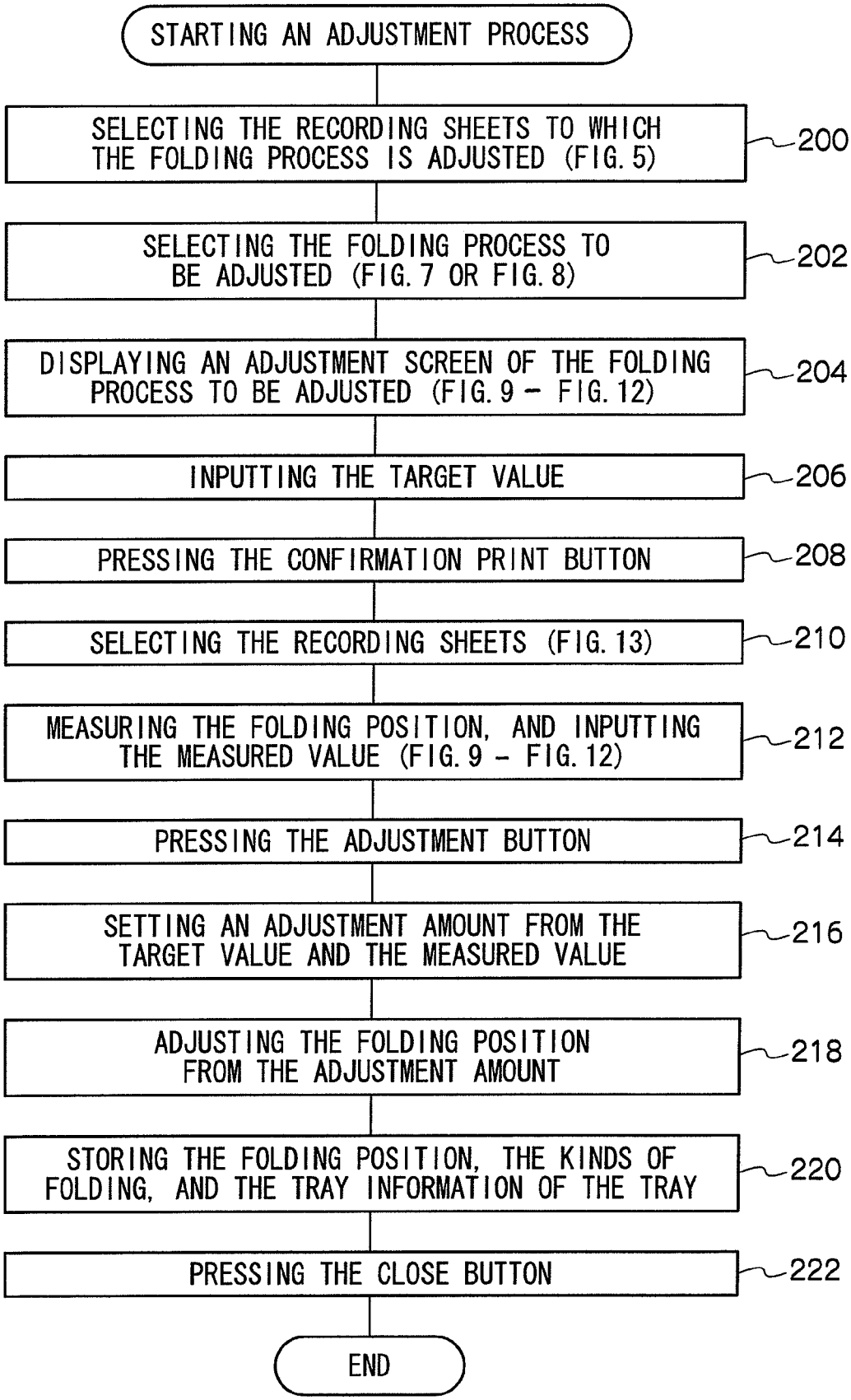
FIG. 4 is a flow chart showing a flow of the adjustment process of the folding position according to the first exemplary embodiment.

FIG. 4 is a flow chart showing a flow of the adjustment process of the folding process.

At step 200, an item corresponding to the recording sheets 18 for which the folding process is adjusted is selected. The selection of the recording sheets 18 is carried out in an item selection screen of the recording sheets 18 shown in FIG. 5.

Figure 5:
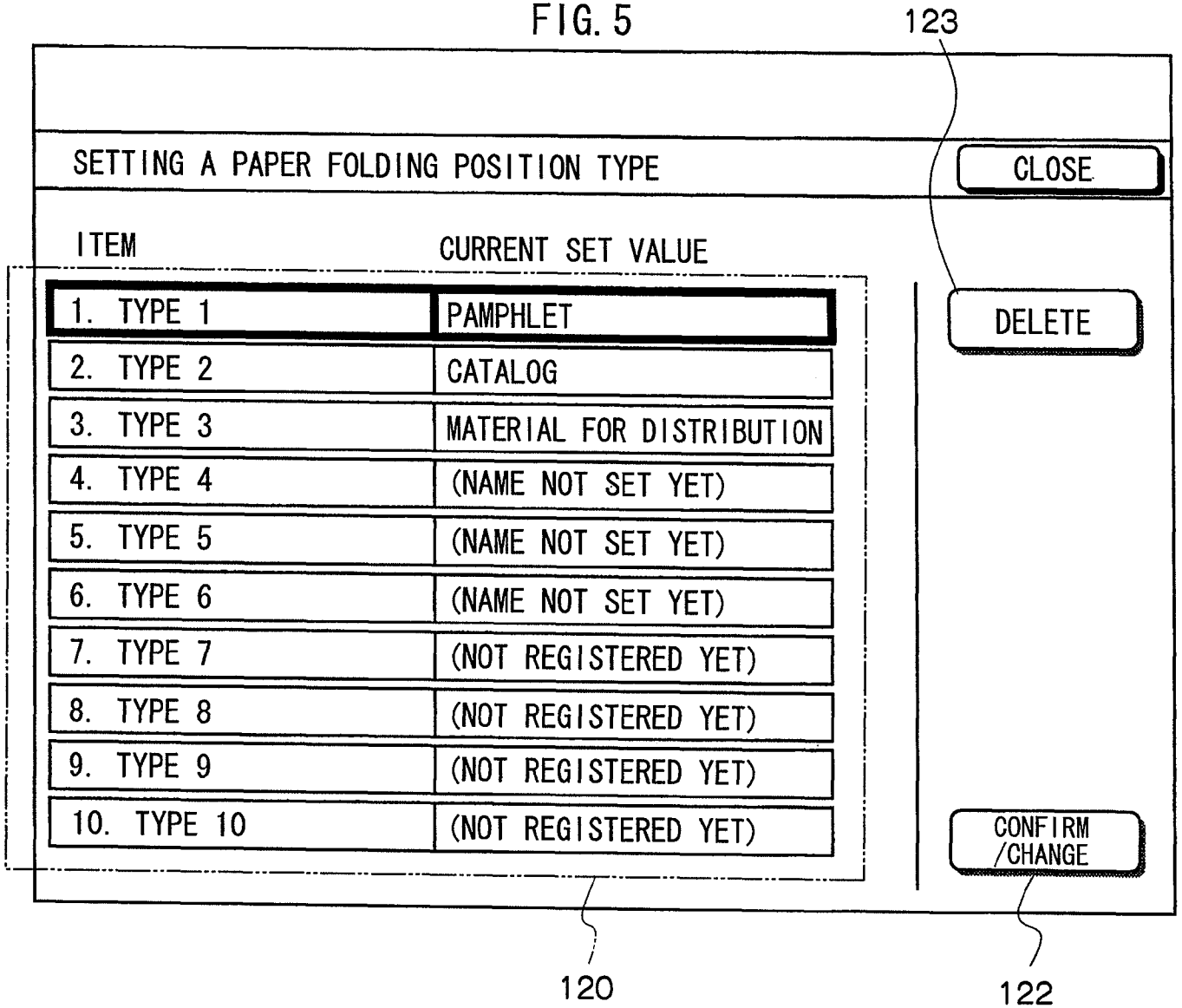
FIG. 5 is a figure showing a setting screen to set the folding position of the recording sheets according to the first exemplary embodiment.

As shown in a selection area 120 of FIG. 5, as for the recording sheets 18 whose folding process is adjusted, their names may be changed into "pamphlet", "catalogue" and the like according to uses of the recording sheets 18. In addition, as for the recording sheets 18 whose folding process is not adjusted yet, they are displayed as "(not registered yet)", Further, as for the recording sheets 18 whose folding process is carried out, but their name are not changed, they are displayed as "(name not set yet)" automatically, and they are displayed so that they are distinguished from "(not registered yet)" that shows the folding process is not adjusted yet.

In addition, the item of the recording sheets 18 whose folding process is adjusted may be deleted by pushing a delete button 123. In addition, the adjustment amount can be changed newly and the adjustment that is previously registered can be changed.

Figure 6:
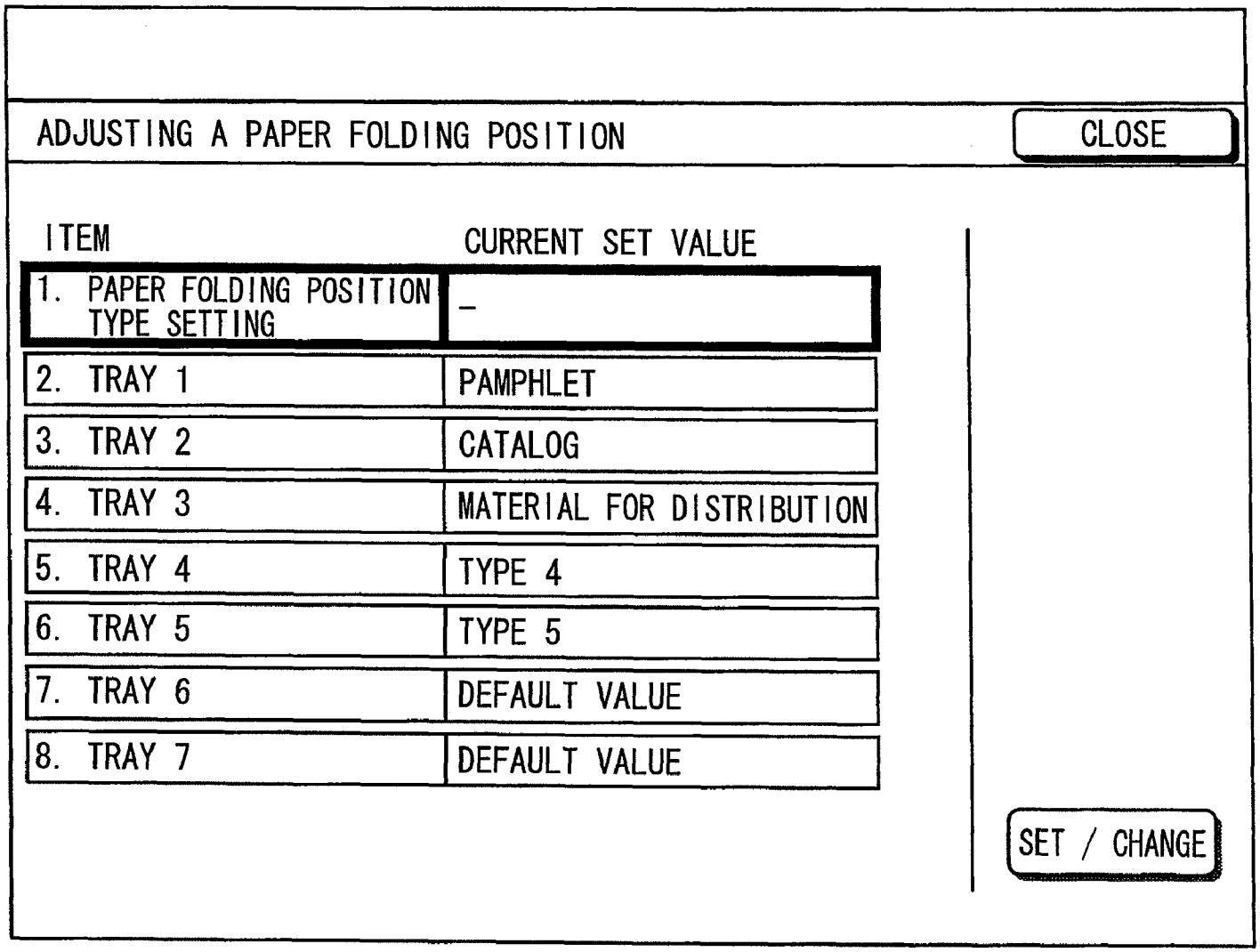
FIG. 6 a figure showing a setting screen to confirm and change allocations of sheet trays according to the first exemplary embodiment.

In addition, adjustment may be assigned to the tray 22 containing the recording sheets 18 as shown in FIG. 6. When the item of the recording sheets 18 assigned to the tray 22 is selected in a selection area 120 shown in FIG. 5, and the delete button 123 is pressed, a warning is displayed, and it is not deleted.

That is, in the case of the deletion process, if the sheet tray to which identification information of the deletion objective is assigned is in its loading state, a warning is given prior to the deletion process. In addition, in this case, the deletion process may be prohibited, and a warning may be given. On the other hand, the deletion process is admited if the sheet tray to which the identification information of the deletion objective is assigned is not in its loading state.

By doing so, in the case where the sheet tray to which identification information of the deletion objective is assigned is in its loading state, it is possible to prevent deletion by mistake, and in the case where the sheet tray to which identification information of the deletion objective is assigned is not in its loading state, it is possible to delete unnecessary settings by admitting the deletion process.

At the step 200, when, in the selection screen of the recording sheets 18 shown in FIG. 5, an item corresponding to the recording sheets 18 whose changed adjustment value is to be changed, or an item corresponding to the recording sheets 18 to be adjusted newly is selected, and a confirmation/change button 122 is pressed, the process shifts to step 202.

At the step 202, the folding process to be adjusted is selected. The selection of the folding process is carried out in FIG. 7 or FIG. 8.

Figure 7:
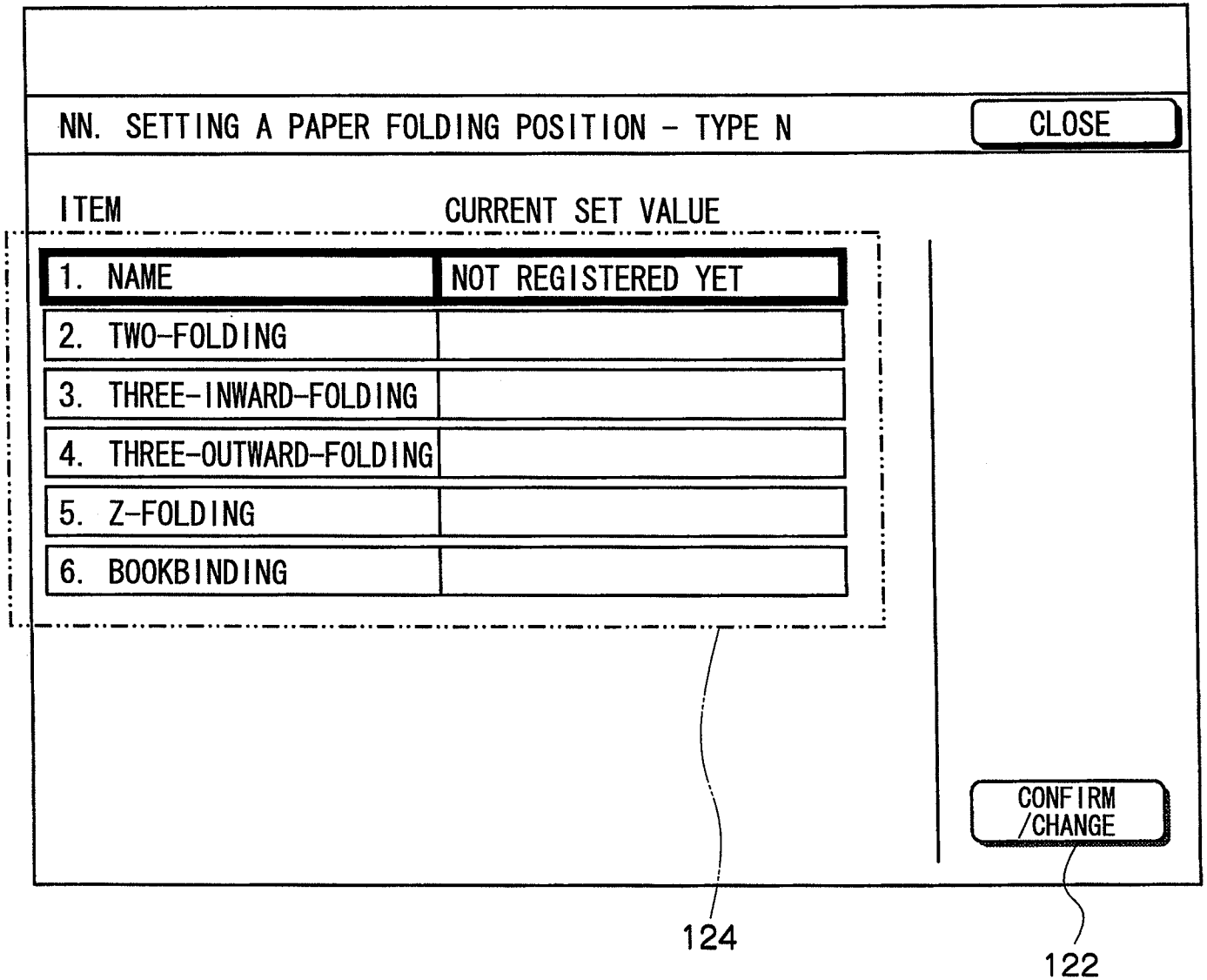
FIG. 7 is a figure showing a setting screen to set an unregistered folding position according to the first exemplary embodiment.

FIG. 7 is the selection screen of the folding process when the adjustment of the folding process is carried out newly. In the selection area 124 of the selection screen of the folding process shown in FIG. 7, the folding process to be adjusted is selected, and the confirmation/change button 122 is pressed.

Figure 8:
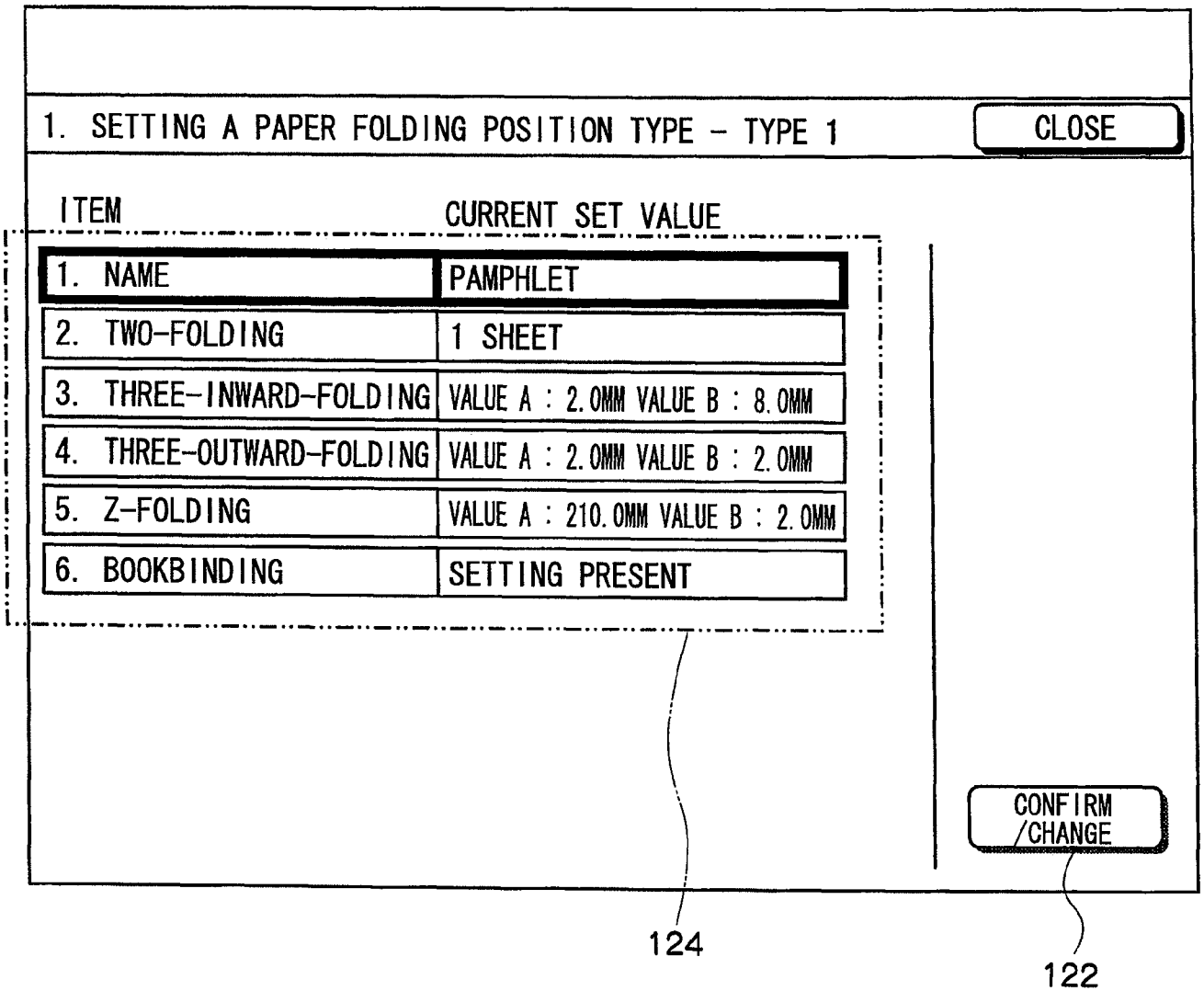
FIG. 8 is a figure showing a setting screen to confirm and change setting contents of the folding position according to the first exemplary embodiment.

FIG. 8 is the selection screen of the folding process when the adjustment value of the adjusted folding process is changed. As shown in FIG. 8, the adjustment value that is previously adjusted is displayed in the selection area 124, and the folding process whose adjustment is carried out is selected. The folding process is selected, and the confirmation/change button 122 is pressed.

At the step 202, when the folding process to be adjusted is selected, the process shifts to step 204.

At the step 204, an adjustment screen of the folding process selected at the step 202 is displayed. As for the adjustment screen of the folding processing, an adjustment screen (any of FIG. 9-FIG. 12) is displayed according to the selected folding process.

Figure 9:
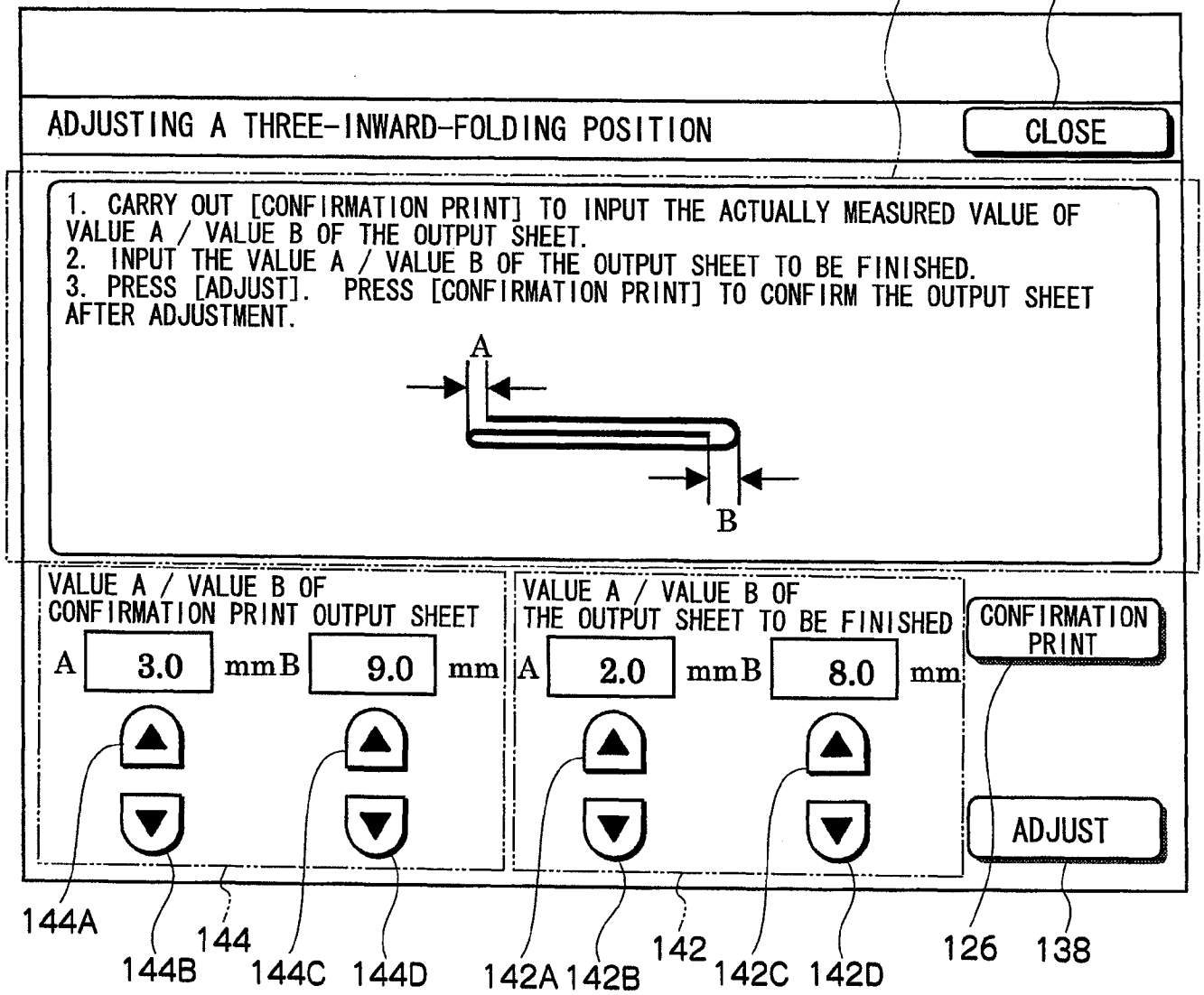
FIG. 9 is a figure showing a setting screen to adjust a three-inward-folding position according to the first exemplary embodiment.
Figure 10:
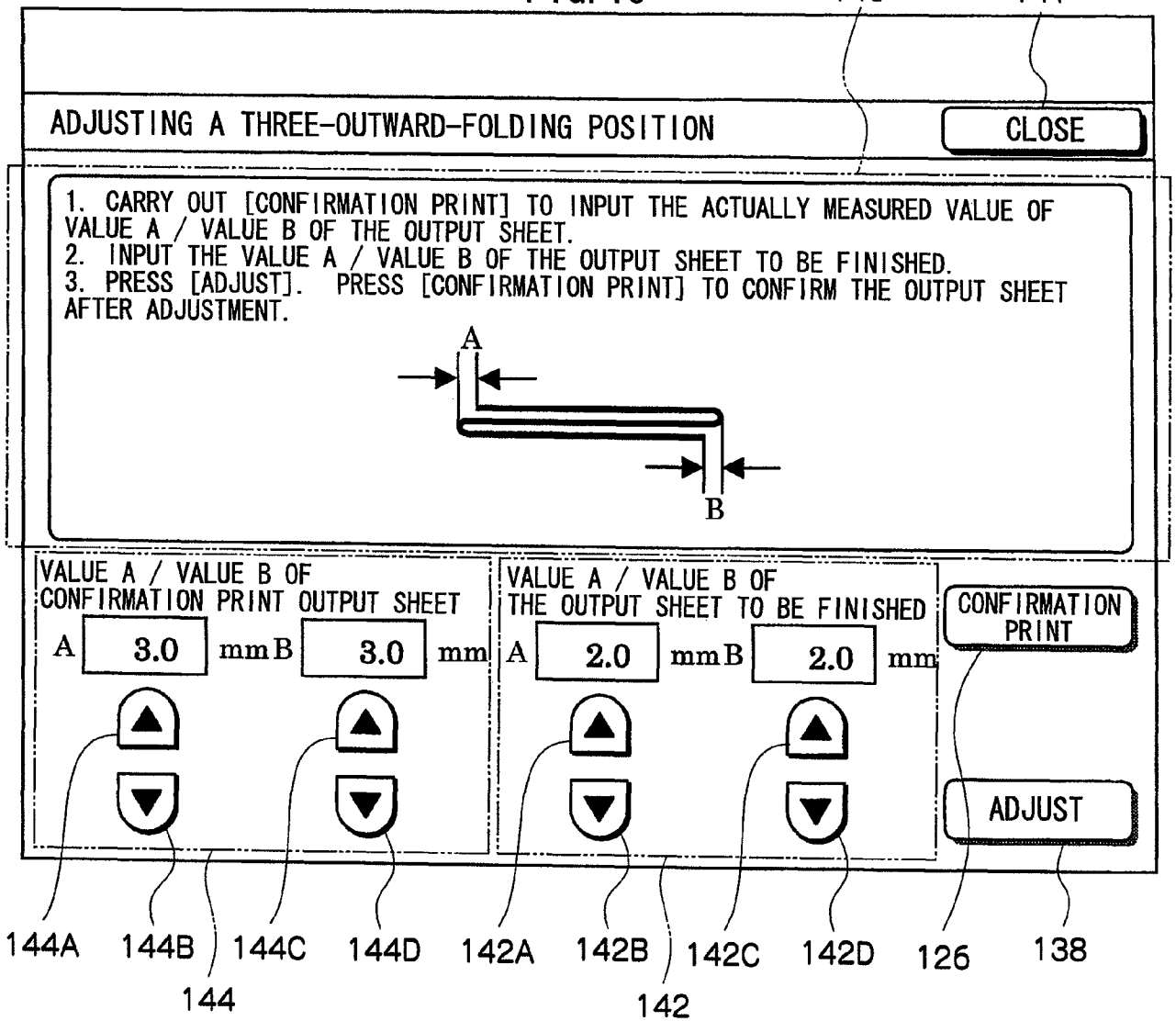
FIG. 10 is a figure showing a setting screen to adjust a three-outward-folding position according to the first exemplary embodiment.
Figure 11:
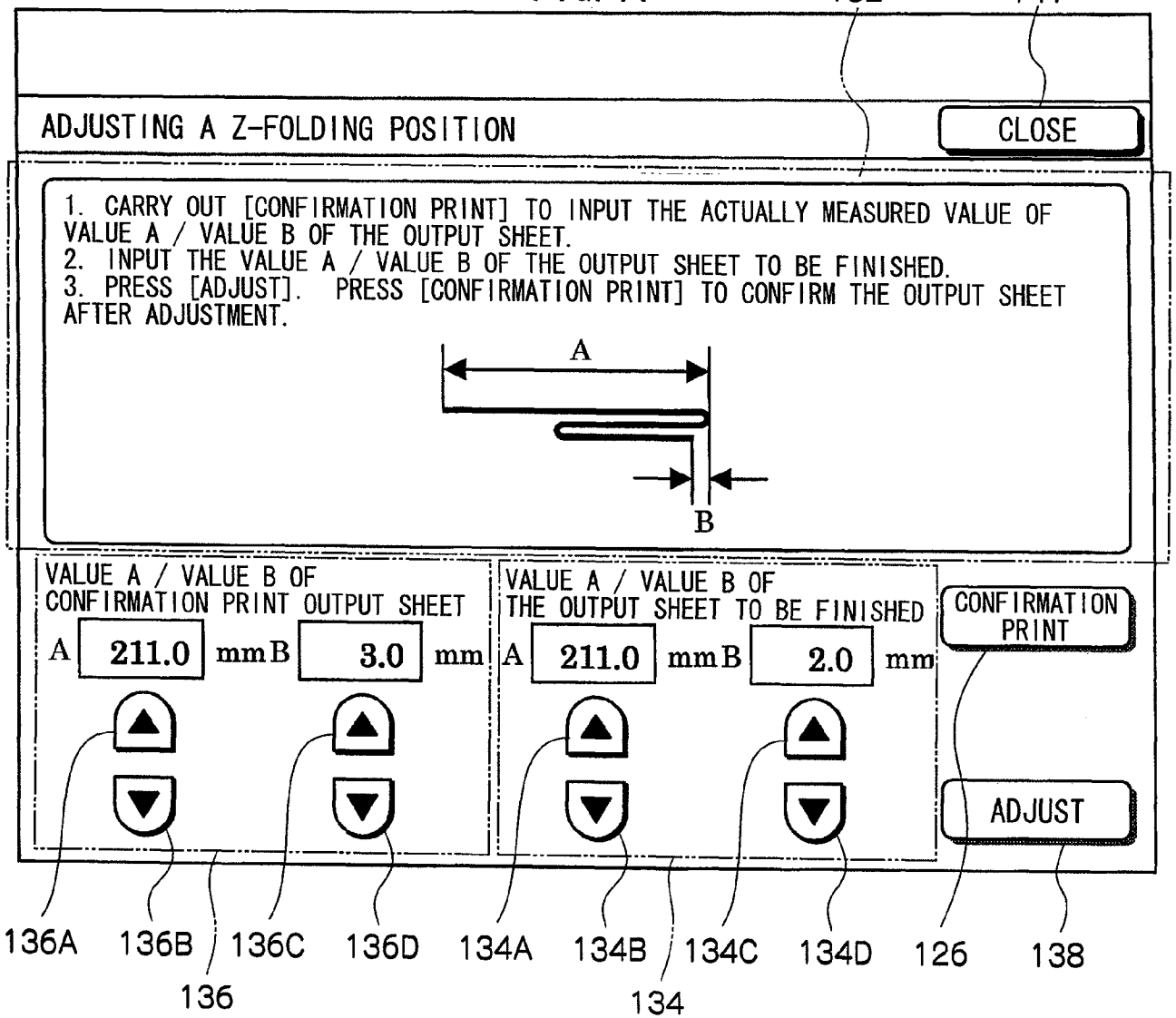
FIG. 11 is a figure showing a setting screen to adjust a Z-folding position according to the first exemplary embodiment.
Figure 12:
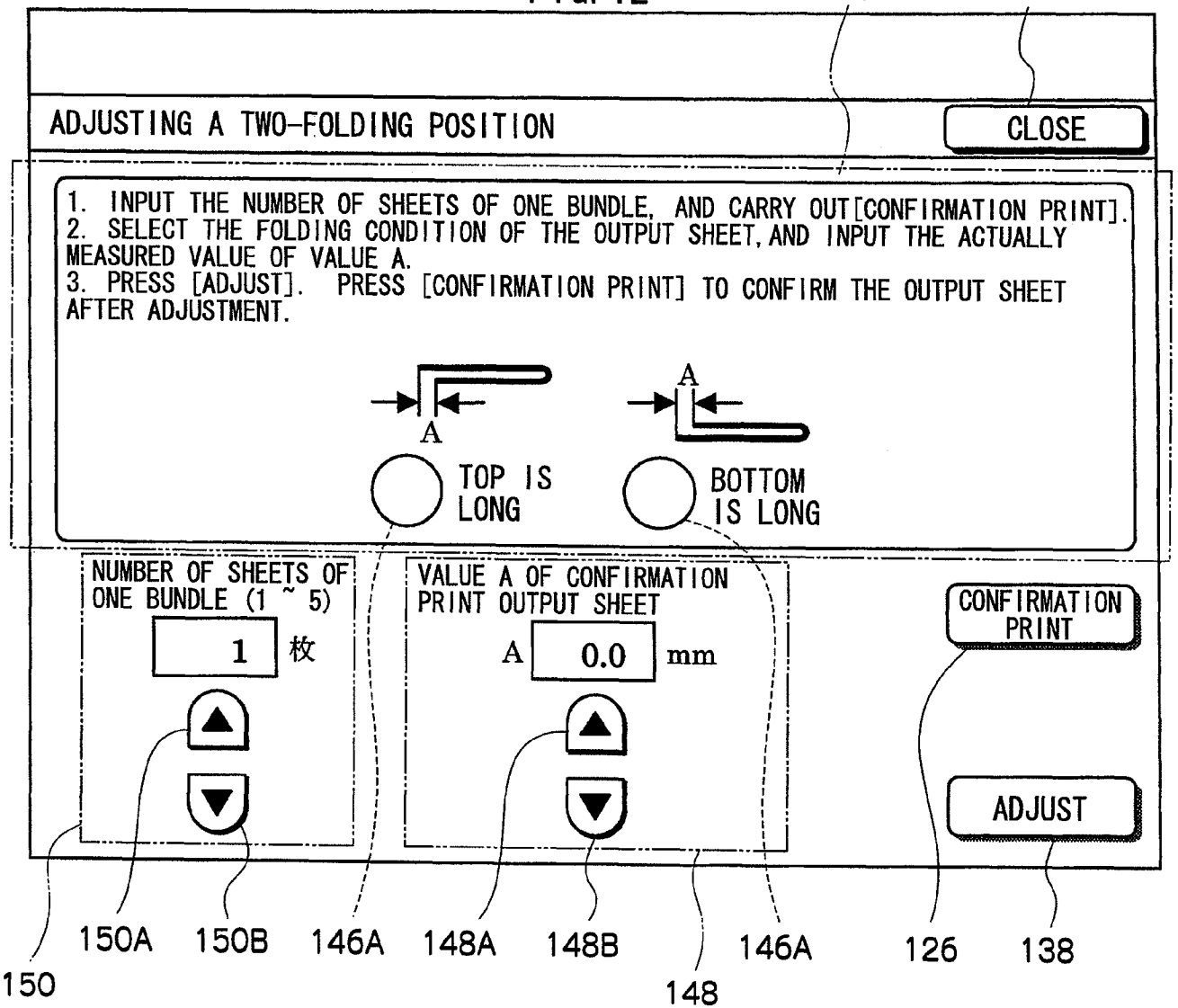
FIG. 12 is a figure showing a setting screen to adjust a two-folding position according to the first exemplary embodiment.

FIG. 9 shows an adjustment screen in case of three-inward-folding, and FIG. 10 shows the adjustment screen of three-outward-folding, and FIG. 11 shows an adjustment screen in case of the Z-folding, and FIG. 12 shows an adjustment screen in case of two-folding.

An adjustment screen (any of FIG. 9-FIG. 12) of the folding process selected at the step 204 is displayed, and the process shifts to step 206.

At the step 206, the target value (in FIG. 9-FIG. 11, "value A/value B of the output sheet to be finished") of the folding position to be carried out in the folding process is input.

In an operation instruction area 140 displayed in the adjustment screen in case of the three-inward-folding shown in FIG. 9 and in the adjustment screen in case of the three-outward-folding shown in FIG. 10, the folding position at which the folding process is carried out is confirmed. The respective values of the value A and the value B shown in the operation instruction area 140 are confirmed, and changed as necessary in a target value input area 142. In the target value input area 142, a previous adjusted value is input when the value is previously adjusted, and a default value is input when the value is adjusted newly. In the case of changing the target value, the value A is input by use of a pullup button 142A and a pulldown button 142B in the target value input area 142, and the value B is input by use of a pullup button 142C and and a pulldown button 142D.

In the operation instruction area 132 displayed in the adjustment screen of the Z-folding shown in FIG. 11, the folding position at which the folding process is carried out is confirmed. The respective values of the value A and the value B shown in the operation instruction area 132 are confirmed, and changed as necessary in the target value input area 134. In a target value input area 134, a previous adjusted value is input when the value is previously adjusted, and a default value is input when the value is adjusted newly. In the case of changing the target value, the value A is input by use of a pullup button 134A and a pulldown button 134B in the target value input area 134, and the value B is input by use of a pullup button 134C and and a pulldown button 134D.

In the adjustment screen of the two-folding shown in FIG. 12, since it is a premise that the folding process is carried out so that the value A shown in the operation instruction area 146 becomes 0.0 mm, there is no target value input area to input the target value of the folding position explained heretofore, and the target value becomes 0.0 mm. In addition, in the first exemplary embodiment, the target value is set at 0.0 mm, and the screen is structured so as not to accept any input, but, in order to cope with such a case where the folding position is displaced intentionally and holes are made in one sheet of a two-folding sheet for filing, the screen may be structured so that a target value can be input.

At step 206, the target value is input, and the step shift to step 208.

At the step 208, a confirmation print button 126 displayed in the selected adjustment screen is pressed, and a confirmation print is carried out. When the confirmation print is carried out, a selection screen of the recording sheets 18 shown in FIG. 13 is displayed, and the process shifts to step 210.

Figure 13:
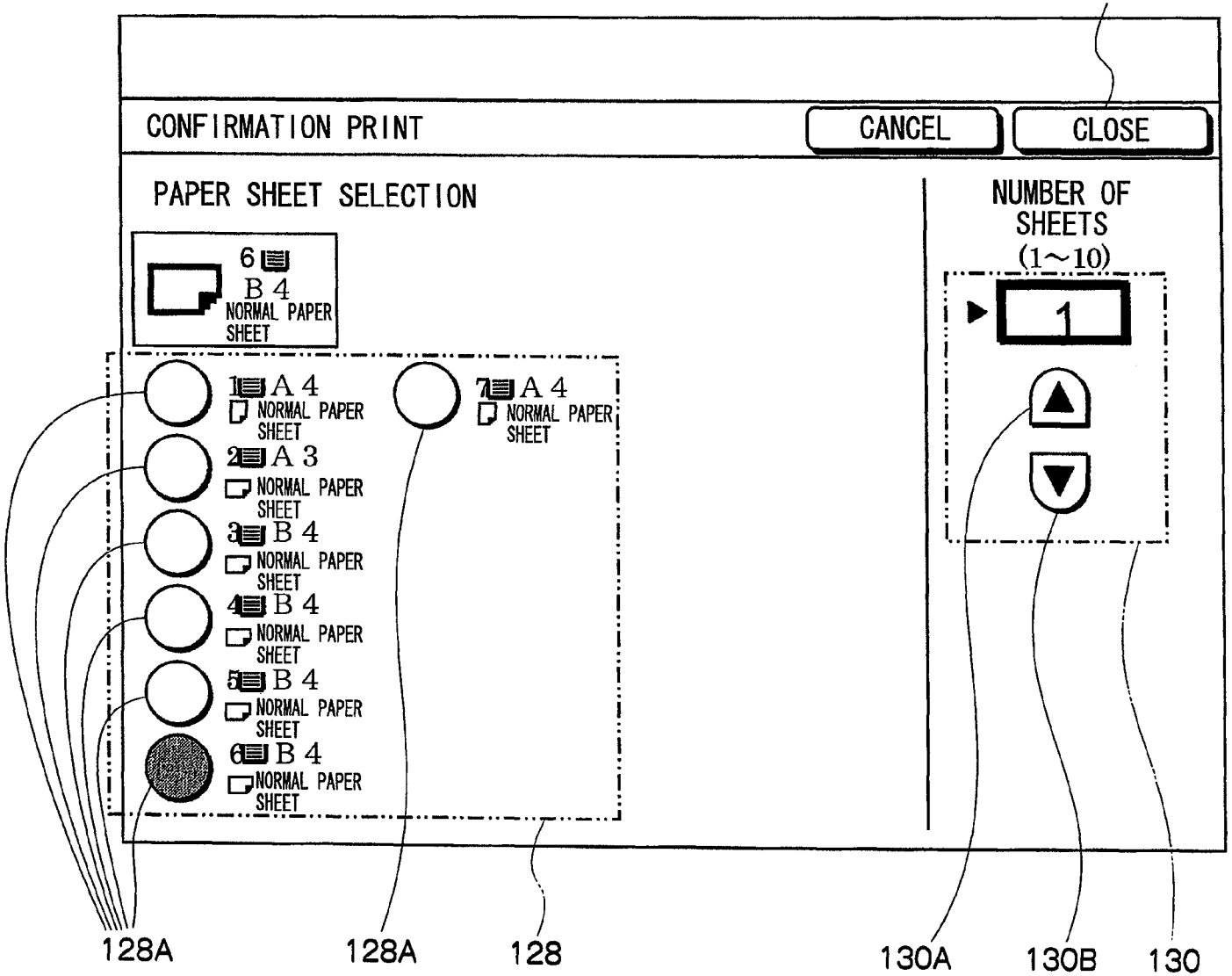
FIG. 13 is a figure showing a setting screen to confirm and change the sheet trays and the numbers of copies at the moment of confirming the print according to the first exemplary embodiment.

At the step 210, the recording sheets 18 on which the confirmation print is carried out are selected in a selection screen of the recording sheets 18 shown in FIG. 13.

As shown in FIG. 13, in the selection screen of the recording sheets 18, it is possible to confirm the recording sheets 18 contained in the set tray 22. In addition, as necessary, it is possible to change the recording sheets 18, by pressing a selection button 128A in the selection area 128. Furthermore, when changing the number of the recording sheets 18 to be output by the confirmation print process, it is possible to change the number of copies, by pressing a pullup button 130A and a pulldown button 130B in a number of copies change area 130. When the recording sheets 18 are confirmed, or changed, and a close button 131 is pressed, the folding process is carried out to the recording sheets 18, and the recording sheets 18 to which the folding process has been carried out are output, and the adjustment screen on which the folding process has been changed is displayed again. As for the recording sheets 18 to which the folding process has been carried out, a marker is printed on the top surface of the recording sheets 18 so that the processed top surface can be distinguished.

At step 210, when the recording sheets on which the confirmation print is carried out is selected, the process shifts to step 212.

At step 212, an adjustment screen (any of FIG. 9-FIG. 12) selected at the step 204 is displayed, the folding position of the recording sheets 18 output by carrying out the confirmation print is measured, and the measured value of the folding position ("value A/value B of the confirmation print output sheets" in FIG. 9-FIG. 11 and "value A of the confirmation print output sheets" in FIG. 12 are displayed) is input. The measurement of the folding position of the recording sheets 18 is performed with the marker printed on the output recording sheets 18 as the upper surface.

In the adjustment screen in the case of the three-inward-folding shown in FIG. 9, and in the adjustment screen in the case of the three-outward-folding shown in FIG. 10, the measured value A is input by use of a pullup button 144A and a pulldown button 144B in a measured value input area 144, and the value B of the measured value is input by use of a pullup button 144C and a pulldown button 144D.

In the adjustment screen in the case of the Z-folding shown in FIG. 11, the measured value A is input by use of a pullup button 136A and a pulldown button 136B in the measured value input area 136, and the value B of the measured value is input by use of a pullup button 136C and a pulldown button 136D.

In the adjustment screen in the case of the two-folding shown in FIG. 12, by use of an instruction button 146A in the operation instruction area 146, it is instructed whether the value A has a long top or a long bottom. Next, the measured value A is input by use of a pullup button 148A and a pulldown button 148B in the measured value input area 148. In addition, in the two-folding process, since plural recording sheets 18 can be folded into two as one bundle, the number of the recording sheets 18 in the bundle is input by use of a pullup button 150A and a pulldown button 150B in the number of sheets appointment area 150. Meanwhile, the number of sheets of one bundle of the recording sheets 18 is appointed as 1-5 sheets in FIG. 12 of the first exemplary embodiment, but the present invention is not limited to this, and it may be made to be processable.

At step 212, the output recording sheets 18 are measured, and when the measured value is input, the process shifts to step 214.

At the step 214, an adjustment button 138 displayed in the adjustment screen of the selected folding process is pressed, and the process shifts to step 216.

At the step 216, the setting unit 102 sets an adjustment amount from the target value of the folding position input at the step 206, and the measured value input at the step 212, and the process shifts to step 218.

At the step 218, the folding position is adjusted from the adjustment amount that the setting unit 102 sets, and the process shifts to step 220.

At the step 220, the memory control unit 106 stores the folding position that the setting unit 102 sets, the kinds of folding, and the tray information of the tray in which the recording sheets 18 are contained into the nonvolatile memory, and the process shifts to step 222.

At the step 222, a close button 141 of the adjustment screen of the selection folding process is pressed, and this routine is finished.

In the folding process, from the measured value of the folding position obtained by measuring the recording sheets 18 after the folding process, and from the input target value or the target value of the preset folding position, the adjustment amount of the folding position is set, and thereby it is possible to adjust the folding position, and simplify the adjustment work of the folding processing of the recording sheets.

In addition, since the UI including an input device to input setting information an output device to display information is equipped, it is possible to simplify the settings, in comparison with the case without being equipped with a user interface.

Second Exemplary Embodiment

In the above first exemplary embodiment, the adjustment of the folding position at which one sheet of the recording sheets 18 is folded basically, as long as the setting of the number of sheets is not changed. In a second exemplary embodiment, the adjustment of the folding position and the binding position in the pamphlet preparation process of a combined process where a preset number of the recording sheets 18 are piled up and bound with staples, and then folded into two is explained.

Meanwhile, in this second exemplary embodiment, it should be noted that the same numerals are given to the same components as those in the first exemplary embodiments for omitting the repeated explanations thereof in all drawings for explaining the embodiments.

In this second exemplary embodiment, in addition to the two-folding process of a set number of recording sheets 18, a binding process where sheets are bound with staples is carried out. As for the two-folding process, there is no difference in the folding position of the recording sheets after the folding process, and as for the binding position, two-folding positions are bound. Therefore, to the UI 100 of the functional block figure (refer to FIG. 3) of the first exemplary embodiment, the respective measured values of the folding position and the binding position after the pamphlet preparation process, the sheet quality information of the recording sheets 18, the information of the tray 22 in which the recording sheets 18 are contained, and the number of the recording sheets 18 are input. The UI 100 sends out the the respective measured values of the folding position and the binding position after the pamphlet preparation process, and the sheet quality information of the recording sheets 18 to the setting unit 102, sends out the information of the tray 22 in which the recording sheets 18 are contained to the memory control unit 106, and sends out the number of the recording sheets 18 to the correcting unit 112.

The setting unit 102 calculates the respective adjustment amounts of the folding position and the binding position, on the basis of the respective measured values of the the folding position and the binding position after the pamphlet preparation process sent out from the UI 100, and the sheet quality sheets 18, and sends them out to the adjustment unit 104.

The adjustment unit 104 adjusts the folding position and the binding position of the recording sheets 18, on the basis of the respective adjustment amounts of the folding position and the binding position sent from the setting unit 102.

The postprocessing unit 108 performs the folding process by the pamphlet preparation unit 50 (refer to FIG. 1), on the basis of the adjustment by the adjustment unit 104.

Hereinafter, the action of the second exemplary embodiment is explained.

In the image forming device 10, when image data is input into the main body 12, an image is formed by the image forming unit 20 on the basis of the input image data, and the recording sheet 18 is transported from the tray 22, and the formed image is transferred onto the recording sheet 18, and thereby, the image formation (print processing) is completed.

When other postprocessing instruction than the imaging instruction is input from the UI 100, the recording sheets 18 one which an image is formed are sent into the finisher 16.

In the finisher 16, according to the postprocessing instructions input from the UI 100, in the case of the folding process, the postprocessing is carried out by the folding unit 54, and in the case of the stapling process, the postprocessing is carried out by the staple unit 52, and in the case of the pamphlet preparation process where a preset number of the recording sheets 18 are piled up and bound, and then folded into two, the postprocessing is carried out by the pamphlet preparation unit 50.

In the postprocesses, there are cases where, when the recording sheets 18 after the pamphlet preparation process are checked, the folding process and the binding process are not carried out at a desired folding position, and the folding position and the binding process should be adjusted. The folding position has been so far adjusted by a customer service engineer, but the folding position can be adjusted by using the UI 100.

In addition, the adjustment of the folding position and the binding position of the pamphlet preparation process may be appliable to the case where the default folding position and binding position set for recording sheets 18 as standard at the time of factory shipment of the image forming device 10 are adjusted, or the case where the folding position and the binding position are changed to the adjustment amounts that are previously adjusted, or when a displacement of the folding position and the binding position that occurs as time goes by is adjusted.

Figure 14:
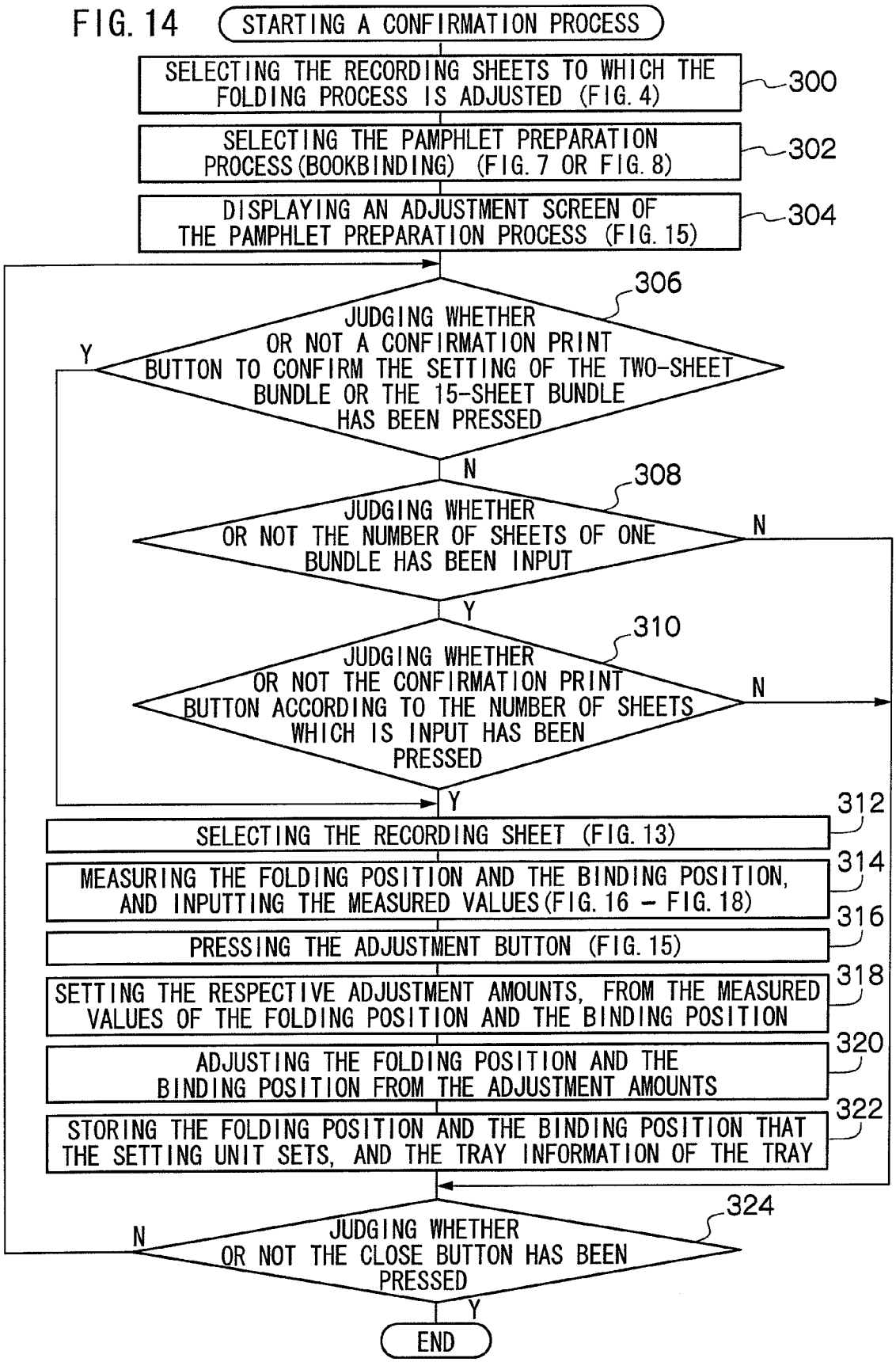
FIG. 14 is a flow chart showing a flow of an adjustment process of the folding position and binding position in a pamphlet preparation process according to a second exemplary embodiment.

FIG. 14 is a flow chart showing a flow of the adjustment process of the folding process and the binding process of the pamphlet preparation process.

At step 300, the recording sheets 18 corresponding to the pamphlet preparation process to be adjusted are selected, in the selection screen of the recording sheets 18 shown in FIG. 4.

At step 302, the pamphlet preparation process (displayed as "bookbinding" in FIG. 7 or FIG. 8) is selected in the postprocessing selection screen shown in FIG. 7 or FIG. 8 corresponding to the selected recording sheets 18.

At step 304, an adjustment screen (FIG. 15) of the pamphlet preparation process is displayed.

Figure 15:
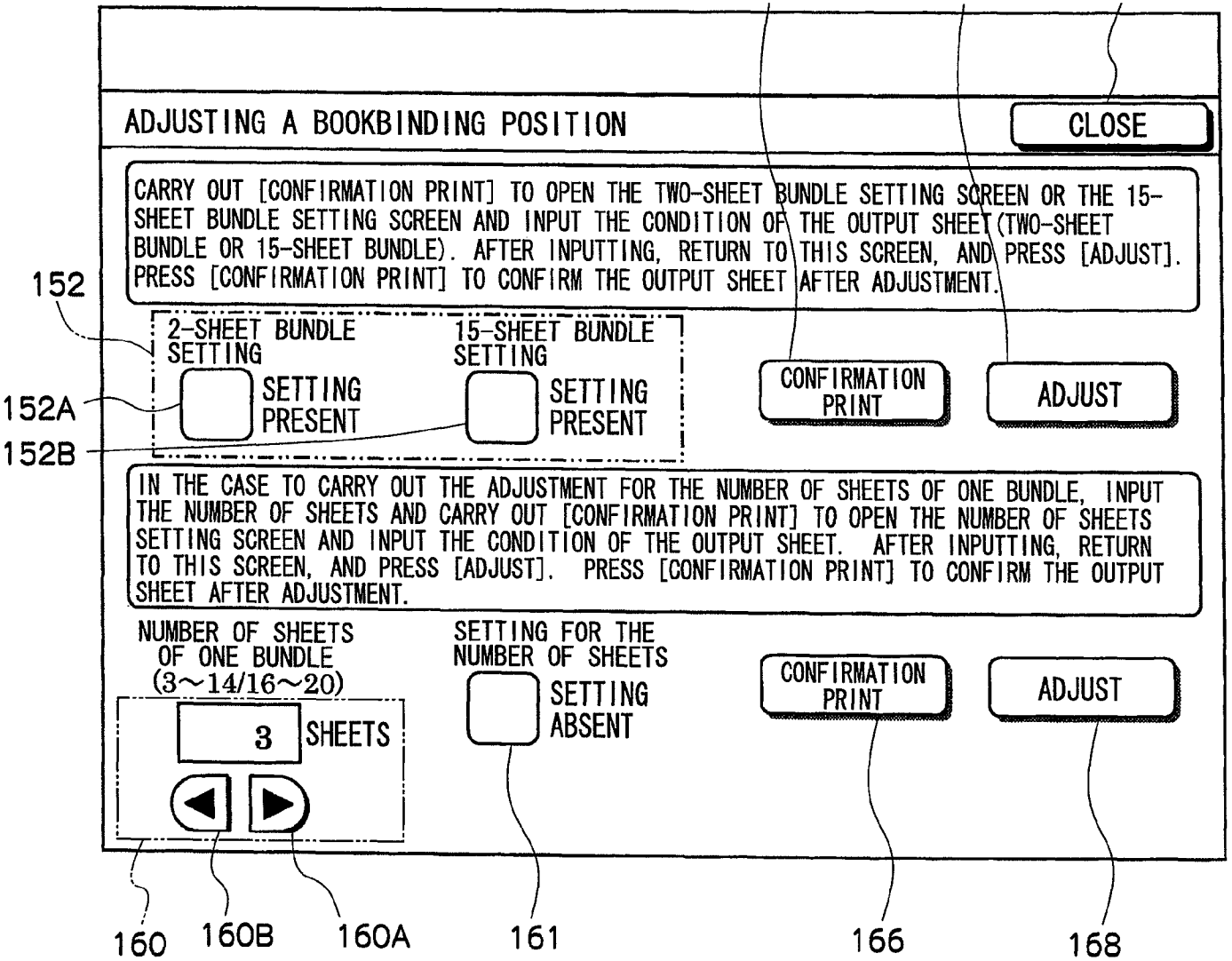
FIG. 15 is a figure showing a setting screen to adjust a bookbinding position according to the second exemplary embodiment.

FIG. 15 is the adjustment screen for carrying out the adjustment of the pamphlet preparation process. When in a setting area 152, as shown in FIG. 15, a two-sheet bundle (selection button 152A), or a 15-sheet bundle (selection button 152B) which are the numbers of the recording sheets to be bound as a bundle of one pamphlet is selected, the adjustment is carried out. The reason why the setting of a two-sheet bundle is performed as one bundle is that at least two or more recording sheets 18 are bound as one pamphlet. In addition, the reason why the setting of a 15-sheet bundle is performed as one bundle is that the processable maximum number of the recording sheets 18 is 15 sheets.

By setting the adjustment amounts of the binding process of two numbers of recording sheets at the minimum value and the maximum value at which the binding process can be performed, it is possible to perform more precise interpolation than in the case where the setting is not carried out at the minimum value and the maximum value at which the binding process can be performed.

Meanwhile, the processable maximum number of sheets is not limited to the 15-sheet bundle, and it can be changed. In particular, for example, in the case where it is known beforehand that linearity of the adjustment value collapses near the processable maximum number of the pamphlet preparation process, a number that is smaller than the processable maximum number of sheets may be set as the number of sheets at which linearity can be maintained. On the contrary, in the case where, even if linearity collapses, the frequency of preparation of pamphlets near the maximum processable number of sheets is high, the adjustment may be performed at two numbers of the recording sheets near the the maximum processable number of sheets intentionally, to make it possible to perform the adjustment more effectively. In addition, as for the adjustment amounts of the two-sheet bundle and the 15-sheet bundle, adjustment amounts for the recording sheets 18 to become the standard are preset as default values.

By setting the number of the recording sheets to become the objectives of the adjustment amounts, it is possible to obtain more precise adjustment amounts with respect to the set number of the recording sheets than in the case where the number of the recording sheets is not set.

By setting the folding positions and the the binding positions of the two-sheet bundle, and setting the folding positions and the the binding positions of the 15-sheet bundle, the numbers of bundles from two to 15 are interpolated from the set values for the two-sheet bundle and the 15-sheet bundle.

By setting the adjustment amounts to the binding process of two numbers of recording sheets of the two-sheet bundle and the 15-sheet bundle, as for the numbers of bundles from two to 15, it is possible to interpolate the numbers on the basis of the set adjusted adjustment amounts, and to omit the adjustment for every of all numbers of sheets in the binding process.

In addition, in the case where the preparation of pamphlets by bundling up a specific number of sheets is often carried out, it is possible to perform the adjustment by designating the number of the recording sheets 18 to be bundled by use of a pullup button 160A and a pulldown button 160B in the number of sheets setting area 160, and pressing a selection button 161. In the case where a specific number of sheets is designated, interpolation is not carried out for the set values from the two-sheet bundle and the 15-sheet bundle, and the adjustment value adjusted by the designated number of sheets is used.

In other words, in the adjustment amounts of the binding process of the two numbers of recording sheets, there are default values, and it is possible to omit the process to set the adjustment values with respect to the binding process of the two number of recording sheets.

At step 304, an adjustment screen of the pamphlet preparation process is displayed, and the process shifts to step 306.

At step 306, it is judged whether or not a confirmation print button 162 to confirm the setting of the two-sheet bundle or the 15-sheet bundle shown in FIG. 15 has been pressed. In the case of the negative judgment that the confirmation print button 162 has not been pressed, the process shifts to step 308, and in the case of the affirmative judgment that the confirmation print button 162 has been pressed, the process shifts to step 312.

At the step 308, it is judged whether or not the number of sheets of one bundle of the recording sheets 18 has been designated by use of a pullup button 160A and a pulldown button 160B in the number of sheets setting area 160 shown in FIG. 15. In addition, as for the designation of the number of sheets, since the two-sheet bundle and the 15-sheet bundle can be designated by use of a setting button 152A (for the setting of the two-sheet bundles) and a setting button 152B (for the setting of the 15-sheet bundles) in a setting area 152, the designation of the number of recording sheets 18 becomes 3 sheets-14 sheets, or 16 sheets-20 sheets. In addition, the reason that the setting of 16 sheets-20 sheets can be made is because this is the upper limit of the processing capacity of the finisher 16, and the present invention is not limited to this value range.

At the step 308, in the case of the affirmative judgment that the number of sheets of one bundle of the recording sheets 18 has been input, the process shifts to step 310, and in the case of the negative judgment that the number of sheets of one bundle of the recording sheets 18 has not been input, the process shifts to step 324.

At the step 310, it is judged whether or not a confirmation print button 166 to perform confirmation according to the number of sheets which is input at the step 308 has been pressed. In the case of the affirmative judgment that the confirmation print button 166 has been pressed, the process shifts to step 312, and in the case of the negative judgment that the confirmation print button 166 has not been pressed, the process shifts to step 324.

At the step 312, the recording sheet 18 on which the confirmation print is carried out is selected, in FIG. 13, and the process shifts to step 314.

Figure 16:
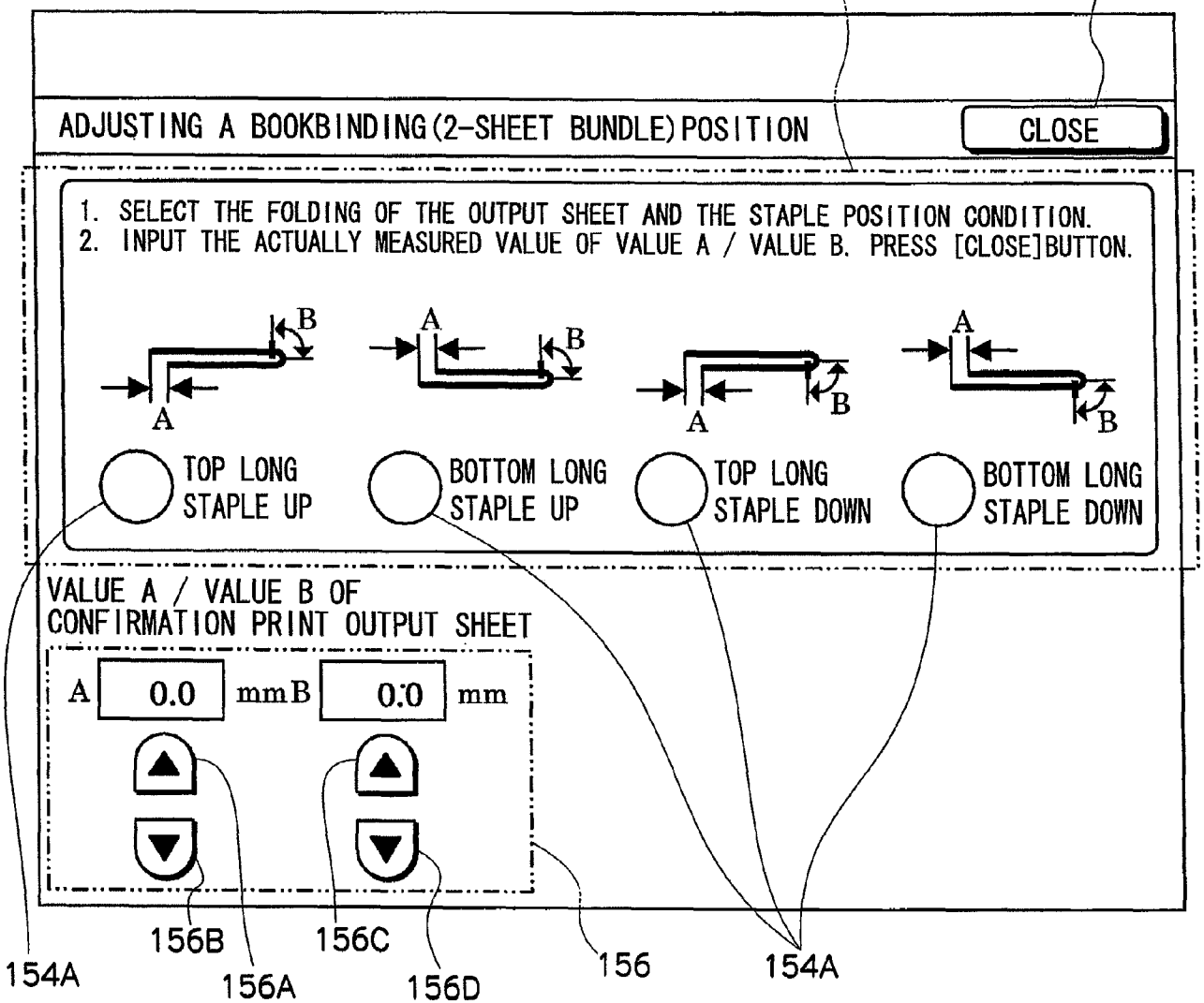
FIG. 16 is a figure showing a setting screen to adjust a bookbinding position of two sheets of bundles according to the second exemplary embodiment.
Figure 17:
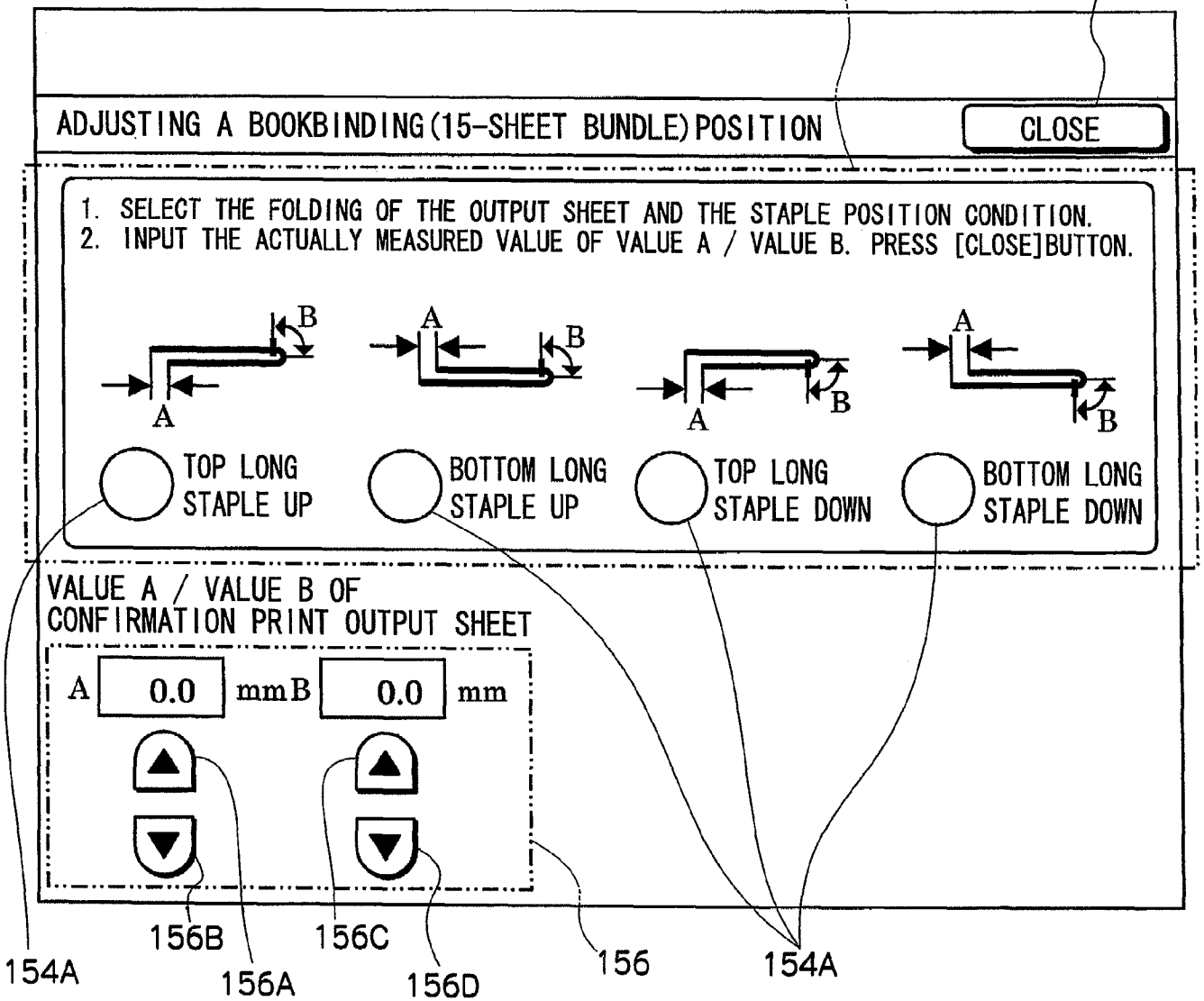
FIG. 17 is a figure showing a setting screen to adjust a bookbinding position of 15 sheets of bundles according to the second exemplary embodiment.
Figure 18:
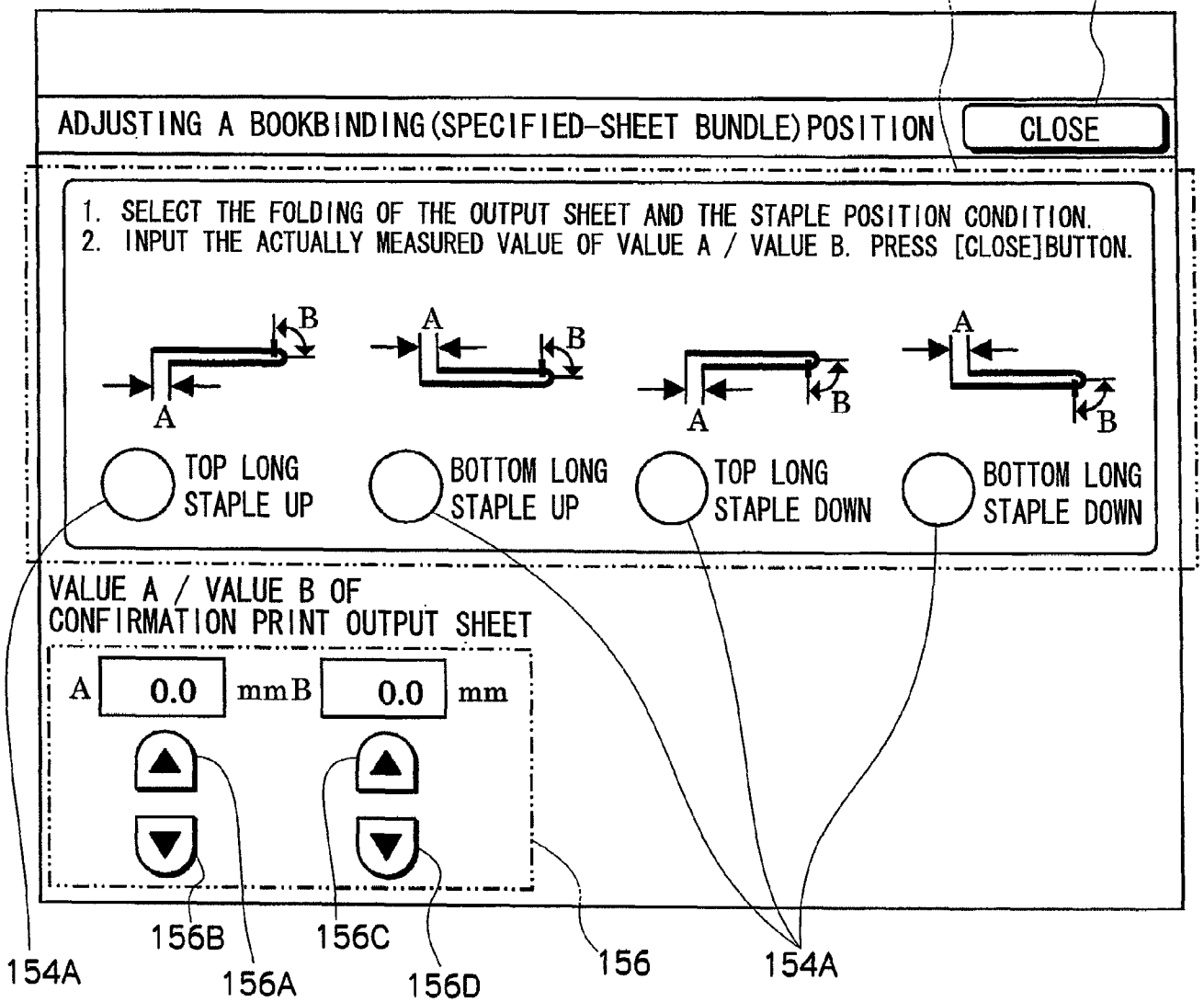
FIG. 18 is a figure showing a setting screen to adjust a bookbinding position of a set number of bundles according to the second exemplary embodiment.

At the step 314, with the surface on which the marker for judging the upper surface of the recording sheets 18 is printed in the confirmation print as a standard, the folding position and the binding position of the output recording sheets 18 are measured, and the measured values are input, in the adjustment screen shown in FIG. 16 in the case of the two-sheet bundles, in the adjustment screen shown in FIG. 17 in the case of the 15-sheet bundles, and in the adjustment screen shown in FIG. 18 in the case where the number of sheets of one bundle is designated.

In any of the cases of the adjustment screen shown to perform the adjustment of the two-sheet bundles (FIG. 16), the adjustment screen shown to perform the adjustment of 15-sheet bundles (FIG. 17), and the adjustment screen shown to perform the adjustment of the designated number of sheets of one bundle (FIG. 18), in a measurement result input area 154, a measurement result button 154A corresponding to the folding position and the binding position of the output result is pressed. Next, in a measured value input area 156, the value A that is the measured value of the folding position shown in the measurement result input area 154 is input by use of a pullup button 156A and a pulldown button 156B. In addition, the value B that is the measured value of the binding position is input by use of a pullup button 156C and a pulldown button 156D. After the value A value that is the measures value of the folding position, and the value B that is the measured value of the binding position are input, a close button 158 is pressed, and FIG. 15 is shown again, and the process shifts to step 316.

At the step 316, in the cases of the two-sheet bundles and the 15-sheet bundles, an adjustment button 164 is pressed, and in the case where the number of sheets of one bundle is designated, an adjustment button 168 is pressed, and the process shifts to step 318.

At the step 318, from the measured values of the folding position and the binding position input at the step 314, the setting unit 102 sets the respective adjustment amounts, and the process shifts to step 320.

At the step 320, the folding position and the binding position are adjusted from the adjustment amounts set by the adjustment unit 104, and the process shifts to step 322.

At the steps 322, the memory control unit 106 stores the folding position and the binding position that the setting unit 102 sets, and the tray information of the tray in which the recording sheets 18 are contained into the nonvolatile memory, and the process shifts to step 324.

Such a memory control unit 106 stores the adjustment amount of the folding process for different recording sheets, or the adjustment amount of the combined process, and thereby, it is possible to perform the postprocess on the basis of the stored adjustment amount after adjustment.

At the step 324, it is judged whether or not the close button 169 shown in FIG. 15 has been pressed. In the case of the negative judgment that the close button 169 has not been pressed, the process shifts to step 306, and in the case of the affirmative judgment that the close button 169 has been pressed, this routine is finished.

In the pamphlet preparation process where a preset number of the recording sheets 18 are piled up and bound, and then folded into two, based on the measured value of the folding position and the measured value of the binding position obtained by the measurement of the recording sheets 18 processed in the pamphlet preparation process, the preset target value of the folding position and the preset target value of the binding position, and the set number of the recording sheets 18, the adjustment amount of the folding position and the adjustment amount of the binding position are set, whereby it is possible to adjust the folding position and the binding position, and thus, it is possible to simplify the adjustment work of the combined process where a preset number of the recording sheets 18 are piled up and bound with staples, and then folded into two.

In addition, in the first exemplary embodiment, and the second exemplary embodiment, even in the case where the adjustment amount of the folding position, or the adjustment amount of the binding position is not registered, in the performance of the postprocess, if the number of the recording sheets 18 in the selected tray 22 is same as the number of the recording sheets 18 of previous registered adjustment amount, it is possible to perform the postprocess on the based on the registered adjustment amount.

Further, in the two-folding process, the maximum number of the sheets of the recording sheets 18 in one bundle to be folded into two, and in the pamphlet processing, the maximum number of the sheets of the recording sheets 18 in one bundle to be processed by the pamphlet preparation process, may be changed according to the quality of the recording sheets 18.

Further, in the adjustment of the folding process and the pamphlet preparation process in the postprocess, in order to simply input the measured value of the recording sheets 18 input in the performance of the confirmation print, a scale may be displayed on the UI 100, or a scale may be printed on the recording sheets 18 that are output.

Furthermore, in the pamphlet preparation process, the adjustment amounts for the two-sheet bundles and the 15-sheet bundles of the recording sheets 18 are set, the adjustment amounts of the numbers of sheets between them is interpolated on the basis of the set adjustment amounts, but the present invention is not limited to this, but interpolation may be carried out in consideration of the adjustment amount where the number of sheets in one bundle is selected.

Moreover, the user interface function may be registered as one of executional functions of an existing user interface in an image forming device. When it is carried out in the existing user interface in the image forming device, it is unnecessary to newly arrange a user interface to adjust the folding process and the compount process of the postprocess.

The foregoing description of the exemplary embodiments of the present invention has been provided for the purposes of illustration and description. It is not intended to be exhaustive or to limit the invention to the precise form disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and the equivalents.

What is claimed is:

1. A postprocessing device comprising:

a postprocessing unit that folds recording sheets at a folding position;

a setting unit that sets an adjustment amount of the folding position based on a target value of the folding position and a measured value of the folding position, said target and measured values are input into the setting unit;

an adjusting unit that adjusts the folding position of the postprocessing unit on the basis of the adjustment amount set by the setting unit; and a correcting unit that corrects the adjustment amount according to a number of the recording sheets to be folded, wherein the correcting unit corrects the adjustment amount for a first number of recording sheets to be folded by interpolating adjustment amounts for at least two numbers of recording sheets, and wherein the adjustment amounts for the at least two numbers of recording sheets are based on target values and measured values.

2. A postprocessing device according to claim 1, further comprising a memory control unit that stores a plurality of adjustment amounts set by the setting unit for a plurality of different types of recording sheets.

3. A postprocessing device according to claim 2, wherein the plurality of the adjustment amounts are identified respectively by identification information, and the identification information for each of the plurality of adjustment amounts is allotted to one of a plurality of sheet trays in which the corresponding type of recording sheets are loaded.

4. A postprocessing device according to claim 1, wherein the setting unit includes a new setting process to set a new adjustment amount, a change setting process to change a previously set adjustment amount, and a delete setting process to delete a previously set adjustment amount.

5. A postprocessing device according to claim 4, wherein the setting unit prevents the delete setting process and gives a warning when the recording sheets are loaded in a sheet tray to which identification information of the delete setting process is allotted.

6. A postprocessing device according to claim 4, wherein the delete setting process is permitted when the recording sheets are not loaded in a sheet tray to which identification information of the delete setting process is allotted.

7. A postprocessing device according to claim 4, wherein the setting unit gives a prior warning when the recording sheets are loaded in a sheet tray to which identification information of the delete setting process is allotted.

8. A postprocessing device according to claim 1, wherein the setting unit is provided with a user interface, the user interface comprising an input device for sequentially and interactively inputting setting information including the measured value and identification information which identifies the adjustment amount, and an output device for displaying information by which it can be visually recognized at least whether or not the adjustment amount is set.

9. A postprocessing device according to claim 1, wherein default adjustment amounts are stored for a second at least two numbers of recording sheets respectively, wherein the correcting unit corrects the adjustment amount for a second number of recording sheets to be folded by interpolating the default adjustment amounts for the second at least two numbers of recording sheets.

10. A postprocessing device according to claim 1, wherein the two numbers of the recording sheets are the minimum number and the maximum number of sheets to which a binding process is possible.

11. A postprocessing device according to claim 1, wherein the correcting unit includes a selecting unit that selects the number of the recording sheets whose adjustment amounts are to be set on the basis of the target value and the measured value.

* * * * *